US006534257B2

(12) United States Patent
Kikuchi

(10) Patent No.: US 6,534,257 B2
(45) Date of Patent: Mar. 18, 2003

(54) SILVER HALIDE PHOTOGRAPHIC EMULSION AND SILVER HALIDE PHOTOGRAPHIC LIGHT-SENSITIVE MATERIAL CONTAINING THE SAME

(75) Inventor: Makoto Kikuchi, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/955,998

(22) Filed: Sep. 20, 2001

(65) Prior Publication Data

US 2002/0081541 A1 Jun. 27, 2002

(30) Foreign Application Priority Data

Sep. 22, 2000 (JP) ..... 2000-288428

(51) Int. Cl.[7] ..... G03C 1/035
(52) U.S. Cl. ..... 430/567; 430/569
(58) Field of Search ..... 430/567, 569

(56) References Cited

U.S. PATENT DOCUMENTS 4,916,052 A * 4/1990 Irving et al. ..... 430/567
5,385,818 A * 1/1995 Maskasky ..... 430/567
5,541,053 A * 7/1996 Martin ..... 430/567
5,587,281 A * 12/1996 Saitou et al. ..... 430/567
5,604,086 A * 2/1997 Reed et al. ..... 430/567
5,698,387 A * 12/1997 Reed et al. ..... 430/567
5,723,278 A * 3/1998 Jagannathan et al. ..... 430/567
5,935,774 A * 8/1999 Bringley et al. ..... 430/567
6,007,977 A * 12/1999 Nishikawa ..... 430/567
6,100,019 A * 8/2000 Brust et al. ..... 430/567
6,127,109 A * 10/2000 Goan ..... 430/567
6,150,080 A * 11/2000 Ando ..... 430/567
6,280,920 B1 8/2001 Maruyama et al.

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photographic emulsion containing silver halide grains. A variation coefficient of distribution of equivalent circle diameters of all the silver halide grains of the silver halide photographic emulsion is 40 to 3%. The silver halide photographic emulsion and contains tabular grains, which satisfy the following requirements (i) to (iv), in an amount of 50% or more of the total projected area of the silver halide grains:

(i) silver bromoiodide or silver bromochloroiodide tabular grains having (111) faces as main planes, (ii) the equivalent circle diameter is 1.0 $\mu$m or more and a thickness is 0.10 $\mu$m or less, (iii) ten or more dislocation lines per grain are present at a fringe portion of the grain, and (iv) when the grain is viewed from a direction perpendicular to the (111) main plane, it has a hexagonal or triangular shape whose edge and/or corner are partly substantially hollowed.

16 Claims, 1 Drawing Sheet

---- IMAGINARY EDGEGS OR CORNERS

—— ACTUAL HEXAGONAL GRAIN WITH PARTLY HOLLOWED EDGES AND / OR CORNERS $d \geqq 0.01\ \mu m$

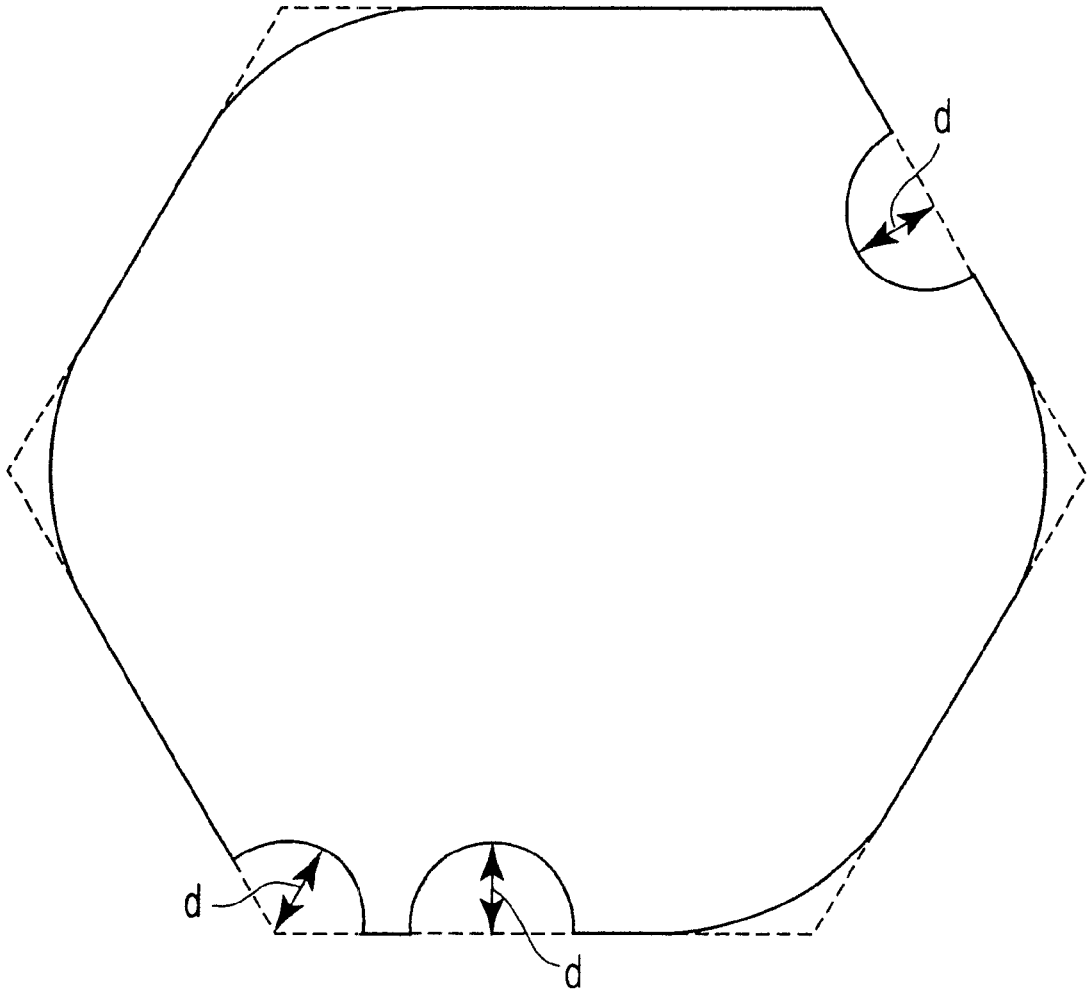
---- IMAGINARY EDGEGS OR CORNERS
—— ACTUAL HEXAGONAL GRAIN WITH PARTLY HOLLOWED EDGES AND / OR CORNERS
$d \geqq 0.01\ \mu m$
FIGURE

SILVER HALIDE PHOTOGRAPHIC EMULSION AND SILVER HALIDE PHOTOGRAPHIC LIGHT-SENSITIVE MATERIAL CONTAINING THE SAME

CROSS-REFERENCE TO RELATED APPLICATIONS

This application is based upon and claims the benefit of priority from the prior Japanese Patent Application No. 2000-288428, filed Sep. 22, 2000, the entire content of which is incorporated herein by reference.

BACKGROUND OF THE INVENTION

The present invention relates to a silver halide emulsion having a high sensitivity and excellent manufacturing suitability (stability of a dissolved coating liquid over time), and a silver halide photographic light-sensitive material using the same.

Recently, in order to match with widely available digital cameras, a silver halide emulsion for photography is desired to have a higher sensitivity and ensure excellent image quality. In particular, a light-sensitive material for color photography having a high sensitivity and ensuring high image quality, capable of being used even in inexpensive cameras which tend to have an insufficient amount of strobe light, such as a lens-fitted film, is strongly desired. As a technique for enhancing the sensitivity of the silver halide emulsion and ensuring the image quality, tabular grains can be used. Known advantages of the tabular grains are, e.g., improvements of the sensitivity, including improvements of the spectral sensitization efficiency obtained by sensitizing dyes, improvements of the sensitivity/graininess ratio, improvements of the sharpness obtained by the specific optical properties of the tabular grains, and improvements of the covering power. In general, the higher the aspect ratio of the tabular grains, the more the sensitivity/graininess ratio is improved, provided that the volumes of the grains are the same.

However, no description relating to an emulsion recited in the claims of the present application is found in patent specifications which disclose the aforementioned tabular grains.

BRIEF SUMMARY OF THE INVENTION

It is an object of the present invention to provide a silver halide photographic emulsion having a high sensitivity and excellent manufacturing suitability (stability of a dissolved coating liquid over time), and a silver halide photographic light-sensitive material using the same.

The inventor has sought to increase the sensitivity of a halide photographic emulsion, using such means as making the tabular grain thinner, introducing high density dislocation lines at a fringe portion of the grains, and chemically sensitizing the emulsion by monodispersing the distribution of equivalent circle diameters. On the other hand, the inventor has found that non-uniformity (sensitivity lowering) in the photographic performance of the silver halide emulsion occurs, as the grains become thinner. It has also been found that the longer the coating liquid is left in a dissolved state over time just before the coating, the greater the degree of sensitivity decrease is; the coating liquid being prepared by mixing the silver halide emulsion, an emulsified product including a coupler, and other chemicals. In the actual manufacture of a silver. halide photographic light-sensitive material, the period of time the coating liquid is kept in a dissolved state varies, due to unexpected causes. In such a case, a silver halide emulsion having a non-uniform sensitivity is unpreferable. Consequently, the inventor has made efforts to eliminate the non-uniformity and found the following. That is, when viewed from a direction perpendicular to a (111) main plane, the coating liquid which contains an emulsion having a large proportion of hexagonal or triangular tabular grains whose edge and/or corner are partly hollowed toward inside thereof, has a higher stability over time when it is dissolved (the sensitivity reduction due to time lapse is small). When the grains of the emulsion were directly observed by a transmission electron photomicrograph, it was observed that the edges and/or corners of the tabular grains were slightly rounded during the period the coating liquid kept in a dissolved state over time. However, the percentage of tabular grains with partly hollowed edges and/or corners after the coating did not significantly vary to that before the coating. It is not certain why the coating liquid which contains an emulsion having a large proportion of tabular grains whose edges and/or corners are partly hollowed, as a result, had a sensitivity which is less reduced during the period the coating liquid remained in a dissolved state. However, it appears that such a small change as to be virtually undetectable even by transmission electron photomicrograph, occurs. In an emulsion having a large proportion of tabular grains with partly hollowed edges and/or corners, such a change already occurred while preparing the emulsion. Afterwards, during the time the coating liquid remained in a dissolved state, such a change that causes a large reduction of the sensitivity may not occur. As described above, the inventor has achieved, for the first time, by the following solving means, the object of coping with both the sensitivity of the silver halide photographic emulsion and the manufacturing suitability (stability of a dissolved coating liquid over time), which were inadequate in the prior art.

As a result of diligent study, the inventor has found that the high sensitivity and the excellent manufacturing suitability (stability of a dissolved coating liquid over time) are compatible by the following improvements of the ultra-thin tabular grain emulsion each having an equivalent circle diameter of 1.0 $\mu$m or more and a thickness of 0.10 $\mu$m or less: (1) introducing dislocation lines at a fringe portion of the grains; (2) when viewed from a direction perpendicular to the (111) main plane, increasing the proportion of hexagonal or triangular tabular grains whose edge and/or corner are partly hollowed; and (3) monodispersing the distribution of equivalent circle diameters of the grains.

The above object of the present invention has effectively been achieved by the silver halide emulsion and the silver halide photographic light-sensitive material using the emulsion, according to the present invention as follows.

That is, (1) A silver halide photographic emulsion containing silver halide grains wherein a variation coefficient of distribution of equivalent circle diameters of all the silver halide grains is 40 to 3%, and tabular grains, which satisfy the following requirements (i) to (iv), account for 50% or more of the total projected area of the silver halide grains:

(i) silver bromoiodide or silver bromochloroiodide tabular grains having (111) faces as main planes, (ii) the equivalent circle diameter is 1.0 $\mu$m or more and a thickness is 0.10 $\mu$m or less, (iii) ten or more dislocation lines per grain are present at a fringe portion of the grain, and (iv) when the grain is viewed from a direction perpendicular to the (111) main plane, it has a hexagonal or triangular shape whose edge and/or corner are partly substantially hollowed toward inside thereof;

(2) The silver halide photographic emulsion according to (1), wherein the tabular grains, which satisfy the above requirements (i) to (iv), account for 80% or more of the total projected area;

(3) The silver halide photographic emulsion according to (1) or (2), wherein the variation coefficient of distribution of equivalent circle diameters of all the silver halide grains is 25 to 3%;

(4) The silver halide photographic emulsion according to (3), wherein the variation coefficient of distribution of equivalent circle diameters of all the silver halide grains is 15 to 3%; and (5) A silver halide photographic light-sensitive material having at least one silver halide emulsion layer on a support, wherein at least one of the silver halide emulsion layers contains the silver halide light-sensitive emulsion described in any one of (1) to (4).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

Single FIGURE is a plan view of one example of a tabular grain having hexagonal shape whose edge and/or corner are partly substantially hollowed toward inside thereof.

DETAILED DESCRIPTION OF THE INVENTION

The silver halide emulsion of the present invention has a high sensitivity in a manufacturing process of a silver halide light-sensitive material and the emulsion of the present invention also has a sensitivity less reduced when a coating liquid for a photographic light-sensitive material, which is prepared by mixing a silver halide emulsion, an emulsified product including a coupler, and other chemicals, is left for a long time in a dissolved state just before the coating. The "long time" means at least 6 hours, preferably 8 hours or more, and more preferably 10 hours.

The silver halide emulsion of the present invention will be described below. As a preferred example of the emulsion, there is provided an emulsion containing silver halide grains wherein a variation coefficient of distribution of equivalent circle diameters of all the silver halide grains is 40 to 3%, and 50% or more of the total projected area of the silver halide grains is occupied by tabular grains of silver bromoiodide or silver bromochloroiodide each having (111) faces as main planes, having an equivalent circle diameter of 1.0 $\mu$m or more and a thickness of 0.10 $\mu$m or less, including ten or more dislocation lines per grain at a fringe portion of the grain, and having a hexagonal or triangular shape whose corner and/or edge are partly substantially hollowed toward inside thereof, when viewed from a direction perpendicular to the (111) main plane.

The form of the silver halide emulsion of the present invention will be described.

In the emulsion of the present invention, 50% or more of the total projected area is occupied by silver bromoiodide or silver bromochloroiodide tabular grains having (111) faces as main planes. The tabular silver halide grain is a general term of silver halide grains having one twin face or two or more parallel twin faces. The twin face indicates the (111) face itself, when ions at all lattice points have a mirror image relationship at both sides of the (111) face. The tabular grain has a triangular or hexagonal shape, when viewed from a direction perpendicular to the main plane, and the edge and/or corner thereof may be partly substantially hollowed toward inside. A grain having a triangular, or hexagonal shape respectively has triangular, or hexagonal main planes parallel to each other.

In the emulsion of the present invention, the projected areas of the tabular grains occupy preferably 100 to 80% of the total projected area of all the grains, more preferably, 100 to 90%, and most preferably, 100 to 95%. If the projected areas of the tabular grains occupy less than 50% of the total projected area of all the grains, the merits of the tabular grains (improvements of the sensitivity/graininess ratio, and of sharpness) cannot be capitalized on, which is unpreferable.

Each of the tabular grains of the present invention preferably has a hexagonal or triangular shape whose corner and/or edge are partly substantially hollowed toward inside thereof, when viewed from a direction perpendicular to the (111) main plane. These edges and corners of the hexagon or triangle may be rounded. The term "the hexagonal or triangular shape whose edge and/or corner is partly substantially hollowed " means that greater than 1%, more preferably 5% or more, and most preferably 10% or more, of the total length of edges of a imaginary hexagon or triangle that is obtained by extending the linear edges, is hollowed with 0.01 $\mu$m or more from the edges of the imaginary hexagon or triangle toward inside the grain, when the grain is viewed from a direction perpendicular to the (111) main plane. Whether the edge and/or corner are partly hollowed or not can be determined by directly observing the tabular grains using a (transmission or scanning) electron microscope.

Specifically, FIGURE is an example of plan view of a hexagonal tabular grain whose edge and/or corner are partly substantially hollowed, when viewed from a direction perpendicular to the (111) main plane. In the hexagonal grain set forth in FIGURE, the hollowed position and number thereof are shown simply for the purpose of illustration, and thus, the present invention is not limited to this.

In FIGURE, solid line and curve together indicate periphery of an actual hexagonal grain. Broken lines indicate the edges and corners of an imaginary hexagon without any hollowed edge and corner. The distance indicated with d is the depth of the hollowed portion. In the present invention, when the length of the hollowed portion of the edge and corner, and the periphery of the imaginary grain meet the following relationship:

(total length of the broken lines/length of periphery of the imaginary hexagon)×100>1, and when d≧0.01 $\mu$m, such grain is one meeting the definition of "edge and/or corner of the hexagonal shape is partly substantially hollowed". The same can be applied to a triangular tabular grain. In this connection, hexagonal tabular grains whose corner is(are) rounded is not the grain "whose edge and/or corner are partly substantially hollowed" defined in the invention.

In the emulsion of the present invention, the projected areas of the tabular grains, having a hexagonal or triangular shape whose edge and/or corner are partly substantially hollowed, when viewed from a direction perpendicular to the (111) main plane, occupy preferably 50% or more of the total projected area of the silver halide grains in the emulsion. More preferably, it is 80% or more of the total projected area. If it is less than 50% of the total projected area, the merits of the tabular grains cannot easily be obtained and is unpreferable.

In order words, in the emulsion of the present invention, the tabular grains having a hexagonal or triangular shape, when viewed from a direction perpendicular to the (111) main plane, in which 1% or more of the total length of the edges of the imaginary hexagon or triangle is not hollowed with 0.01 μm or more, occupy preferably 0 to less than 50% of the total projected area of the silver halide grains in the emulsion. The smaller percentage is preferable. More preferably, the above tabular grains occupy 0 to 20% of the total projected area.

In the emulsion of the present invention, it is preferred that hexagonal tabular grains whose neighboring side ratio (maximum side length/minimum side length) is in the range of 1.5 to 1 occupy 100 to 50% of the total projected area of all the grains of the emulsion. The above hexagonal tabular grains more preferably occupy 100 to 70%, most preferably 100 to 80%, of the total projected area. In the emulsion of the present invention, it is especially preferred that hexagonal tabular grains whose neighboring side ratio (maximum side length/minimum side length) is in the range of 1.2 to 1 occupy 100 to 50% of the total projected area of all the grains of the emulsion. The above hexagonal tabular grains more preferably occupy 100 to 70%, most preferably 100 to 80%, of the total projected area. The mixing of tabular grains other than these hexagonal tabular grains into the emulsion is not favorable from the viewpoint of intergranular homogeneity.

The distance between the twin planes of the tabular grain of the invention can be 0.012 μm or less, as disclosed in U.S. Pat. No. 5,219,720. Also, the ratio of the distance between (111) main planes/the distance between twin planes can be 15 or more, as disclosed in JP-A-5-249585. The distances can be selected depending on purposes.

In the emulsion of the present invention, 50% or more of the total projected area of the silver halide grains in the emulsion is accounted for by the tabular grains having an equivalent circle diameter of 1.0 μm or more and a thickness of 0.10 μm or less. More preferably, it is 80% or more. If the percentage is out of the above range, it is difficult to obtain the advantageous effect of the present invention, which is unpreferable. The "equivalent circle diameter" in the present invention is a diameter of a circle having an area equal to that of a projected area of parallel outer surfaces of the grain.

The projected area of the grain can be obtained by measuring the area on an electron photomicrograph, and correcting the projection magnification. The thickness of the grain can easily be determined by evaporating a metal, with a latex for reference, onto the grain from a slanting direction of the grain, measuring the length of the shadow on the electron photomicrograph, and calculating by referring to the length of the shadow of the latex.

The average equivalent circle diameter of the tabular grains of the present invention is preferably 1.0 to 3.0 μm, more preferably 1.0 to 2.5 μm, and most preferably 1.2 to 2.5 μm. The average equivalent circle diameter is the arithmetic mean of the equivalent circle diameter of all the tabular grains in the emulsion.

The average grain thickness of the tabular grains of the present invention is preferably 0.03 to 0.10 μm, and more preferably 0.05 to 0.08 μm. The average grain thickness is the arithmetic mean of the grain thickness of all the tabular grains in the emulsion. The emulsion wherein the average grain thickness is less than 0.03 μm is difficult to prepare. If the thickness is over 0.01 μm, it is hard to obtain the advantageous effect of the invention, which is unpreferable.

The ratio of equivalent circle diameter to thickness with respect to silver halide grain is referred to as "aspect ratio". That is, the aspect ratio is the quotient of the equivalent circle diameter of the projected area of each individual silver halide grain divided by the grain thickness. One method of determining the aspect ratio comprises obtaining a transmission electron micrograph by the replica technique and measuring the diameter of a circle with the same area as the projected area of each individual grain (equivalent circle diameter) and the grain thickness. This grain thickness is calculated from the length of replica shadow.

The emulsion of the present invention is occupied by tabular grains each having an aspect ratio of 10 to 40 in an amount of preferably, 100 to 50%, more preferably 100 to 80%, of the total projected area of all the silver halide grains contained in the emulsion. Furthermore, the emulsion of the present invention is occupied by tabular grains each having an aspect ratio of 15 to 40 in an amount of preferably, 100 to 50%, more preferably 100 to 80%, of the total projected area of all the silver halide grains contained in the emulsion.

It is preferred that the emulsion of the present invention be composed of monodisperse grains. In the present invention, the variation coefficient of grain size (equivalent sphere diameter) distribution of all silver halide grains is preferably in the range of 35 to 3%, more preferably 20 to 3%, and most preferably 15 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution of all tabular grains exceeds 35% is not favorable from the viewpoint of intergranular homogeneity. On the other hand, it is difficult to prepare an emulsion wherein the variation coefficient is below 3%.

The variation coefficient of equivalent circle diameter distribution of all grains contained in the emulsion of the present invention is preferably in the range of 40 to 3%, more preferably 25 to 3%, and most preferably 15 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all grains exceeds 40% is not favorable from the viewpoint of intergranular homogeneity. On the other hand, it is difficult to prepare an emulsion wherein the variation coefficient is below 3%.

The variation coefficient of grain thickness distribution of all tabular grains contained in the emulsion of the present invention is preferably in the range of 25 to 3%, more preferably 20 to 3%, and most preferably 15 to 3%. The terminology "variation coefficient of grain thickness distribution" used herein means the product obtained by dividing the dispersion (standard deviation) of grain thicknesses of individual tabular grains by the average grain thickness and multiplying the resultant quotient by 100. That the variation coefficient of grain thickness distribution of all tabular grains exceeds 25% is not favorable from the viewpoint of intergranular homogeneity. On the other hand, it is difficult to prepare an emulsion wherein the variation coefficient is below 3%.

The variation coefficient of distribution of distance between twin planes of all tabular grains contained in the emulsion of the present invention is preferably in the range of 25 to 3%, more preferably 20 to 3%, and most preferably 15 to 3%. The terminology "variation coefficient of distribution of distance between twin planes" used herein means the product obtained by dividing the dispersion (standard deviation) of distance between twin planes of individual tabular grains by the average distance between twin planes and multiplying the resultant quotient by 100. That the variation coefficient of distance between twin planes of all tabular grains exceeds 25% is not favorable from the viewpoint of intergranular homogeneity. On the other hand, it is difficult to prepare an emulsion wherein the variation coefficient is below 3%.

In the present invention, although the grain thickness, aspect ratio and monodispersity can be selected within the above ranges in conformity with the purpose of the use thereof, it is desirable to employ monodisperse tabular grains of small grain thickness and high aspect ratio.

In the present invention, various methods can be employed for the formation of tabular grains of high aspect ratio. For example, the grain forming methods described in U.S. Pat. Nos. 5,496,694 and 5,498,516, can be employed.

In the production of monodisperse tabular grains of high aspect ratio, it is important to form twinned crystal nuclei of small size within a short period of time. Thus, it is desirable to perform nucleation within a short period of time under low temperature, high pBr, low pH and small gelatin amount conditions. With respect to the type of gelatin, a gelatin of low molecular weight, a gelatin whose methionine content is low or a gelatin whose amino group is modified with, for example, phthalic acid, trimellitic acid or pyromellitic acid and the like are preferably employed.

After the nucleation, physical ripening is performed to thereby eliminate nuclei of regular crystals, single twinned crystals and nonparallel multiple twinned crystals while selectively causing nuclei of parallel double twinned crystals to remain. Further ripening among the remaining nuclei of parallel double twinned crystals is preferable from the viewpoint of enhancing the monodispersity.

Also, it is preferable to perform the physical ripening, for example, in the presence of PAO (polyalkylene oxide) as described in U.S. Pat. No. 5,147,771, from the viewpoint of enhancing the in monodispersity.

Thereafter, supplemental gelatin is added, and soluble silver salts and soluble halides are added to thereby effect a grain growth. The above gelatin whose amino group is modified with, for example, phthalic acid, trimellitic acid or pyromellitic acid is preferably employed as the supplemental gelatin.

Further, the grain growth can preferably be performed by adding silver halide fine grains separately prepared in advance or simultaneously prepared in a separate reaction vessel to thereby feed silver and halide.

During the grain growth as well, it is important to control and optimize the temperature of reaction mixture, pH, amount of binder, pBr, feeding speeds of silver and halide ion, etc.

In the formation of silver halide emulsion grains for use in the present invention, it is preferable to employ silver iodobromide or silver chloroiodobromide. When there is a phase containing an iodide or a chloride, the phase may be uniformly distributed in each grain, or may be localized therein.

Furthermore, other silver salts, such as silver rhodanate, silver sulfide, silver selenide, silver carbonate, silver phosphate and an organic acid salt of silver, may be contained in the form of other separate grains or as parts of silver halide grains.

In the emulsion grains of the present invention, the silver bromide content is preferably 80 mol % or more, more preferably 90 mol % or more.

The silver iodide content of the emulsion of the present invention is preferably in the range of 1 to 20 mol %, more preferably 2 to 15 mol %, and most preferably 3 to 10 mol %. Silver iodide contents of less than 1 mol % are not suitable because it becomes difficult to realize the effects of enhancing dye adsorption, increasing of intrinsic photographic speed, etc. On the other hand, silver iodide contents of more than 20 mol % are not suitable because the development velocity is generally delayed.

The variation coefficient of intergranular silver iodide content distribution in the emulsion grains for use in the present invention is preferably 30% or less, more preferably 25 to 3%, and most preferably 20 to 3%. That the variation coefficient exceeds 30% is not favorable from the viewpoint of intergranular homogeneity. The terminology "variation coefficient of intergranular silver iodide content distribution" used herein means the product obtained by dividing the standard deviation of silver iodide contents of individual emulsion grains by the average silver iodide content and multiplying the resultant quotient by 100. The silver iodide contents of individual emulsion grains can be measured by analyzing the composition of each individual grain by means of an X-ray microanalyzer.

The measuring method is described in, for example, EP No. 147,868. In the determination of the distribution of silver iodide contents of individual grains contained in the emulsion of the present invention, the silver iodide contents are preferably measured with respect to at least 100 grains, more preferably at least 200 grains, and most preferably at least 300 grains.

The surface iodide content of the emulsion used in the invention is preferably 5 mol % or less, more preferable 4 mol % or less, much more preferably 3 mol % or less. When the surface iodide content exceeds 5 mol %, development inhibition and chemical sensitization inhibition occur, which are not preferable. Measurement of the surface iodide content can be conducted by ESCA method (also known as the XPS method, which is the method in which X-rays are irradiated to grains and photoelectrons emitted from the grain surface are spectralized).

Each of the emulsion grains of the invention mainly comprises (111) faces and (100) faces. A ratio of an area occupied by (111) faces to all the surface area of the emulsion grains is preferably at least 70%.

On the other hand, the portion where (100) faces appear in the emulsion grains of the invention is at side surfaces of the tabular grains. The ratio of an area occupied by (100) faces to the surface area of the emulsion grains, to an area occupied by (111) faces to the surface area of the emulsion grains is preferably at least 2%, more preferably 4% or more. The control of the (100) face ratio can be conducted by referring to the descriptions in JP-A's-2-298935 and 8-334850. The ratio of (100) face can be measured by a method that uses difference of adsorption dependency between (111) face and (100) face to a spectral sensitizing dye, for example, the method described in Tani, J. Imaging Sci., 29, 165(1985).

In the emulsion grains used in the invention, an area ratio of (100) faces in the side faces of the tabular grains is preferably 15% or more, and more preferably 25% or more. The area ratio of (100) faces in the side faces of the tabular grains can be obtained by the method described, for example, in JP-A-8-334850.

The tabular grains used in the invention preferably have a dislocation line at inside the grain. The methods of introducing a dislocation line is explained below.

The dislocation line is a linear lattice defect at the boundary between a region already slipped and a region not slipped yet on a slip plane of crystal.

Dislocation lines in a silver halide crystal are described in, e.g., 1) C. R. Berry. J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Photo. Sci. Jap., 34, 16 (1971); and 5) T. Shiozawa, J. Soc. Phot. Sci. Jap., 35, 213 (1972). Dislocation lines can be analyzed by an X-ray diffraction method or a direct observation method using a low-temperature transmission electron microscope. In direct observation of dislocation lines using a transmission electron microscope, silver halide grains, extracted carefully from an emulsion so as not to apply a pressure by which dislocation lines are produced in the grains, are placed on a mesh for electron microscopic observation. While the sample is cooled in order to prevent damage (e.g., print out) due to electron rays, the observation is performed by a transmission method.

In this case, as the thickness of a grain increases, it becomes more difficult to transmit electron rays through it. Therefore, grains can be observed more clearly by using an electron microscope of high voltage type (200 kV or more for a thickness of 0.25 $\mu$m).

On the other hand, effects of dislocation lines on photographic performance are described in G. C. Farnell, R. B. Flint, J. B. Chanter, J. Phot. Sci., 13, 25(1965), and it mentions that the place where latent image nuclei are formed and defects inside the grain have close relationship, in tabular silver halide grains each having a large size and high aspect ratio. For example, U.S. Pat. Nos. 4,806,461, 5,498,516, 5,496,694, 5,476,760, and 5,567,580, and JP-A's-4-149541 and 4-149737 describe techniques of introducing dislocation lines to silver halide grains under controlled manner. It is demonstrated therein that tabular grains into which dislocation lines are introduced are excellent in sensitivity, pressure property and like, compared with tabular grains having no dislocation lines. In the present invention, the methods of introducing dislocation lines similar to those described in the patent specifications are preferably used.

In the present invention, it is preferable to introduce dislocation lines to inside the tabular grains by the following manner. That is, introduction of dislocation lines by epitaxial growth of silver halide phase containing silver iodide on a base grain (hereinafter referred to as host brain), followed by silver halide shell formation.

The tabular grains of the present invention having a hexagonal or triangular shape whose edge and/or corner are partly substantially hollowed, when viewed from a direction perpendicular to the (111) main plane, can be formed mainly by contrivance in a process of introducing dislocation lines.

In the case of tabular grains, the most easily dissolvable regions of the grain are corner portions and edge portions. In particular, if the tabular grain is thin, these portions tend to be dissolved during or after grain forming, and be hollowed. In order to increase the proportion of such grains, it is preferable to (1) increase the solubility in a reaction system during the grain formation; (2) form grains under a low pAg value; (3) decreasing the iodide content in a grain halogen composition, thereby making the grain itself easily dissolvable; (4) selectively dissolve edge and/or corner of the grains by excessive conversion, etc. To be more specific, it is preferable that the temperature and the pAg value at the time of introducing dislocation lines be properly chosen. It is particularly preferable that the grains be formed under a low pAg value of 8.0 or less. It is also preferable that a silver halide solvent be added, base grains before introducing dislocation lines be pure silver bromoide, or an epitaxial growth phase containing excessive silver iodide be formed. However, the present invention is not limited to these methods, and other methods may be used.

The preferred method of introducing dislocation lines into a tabular grain will be described in detail.

The silver iodide content of the host grain is preferably 0 to 3 mol %, and more preferably 0 to 1 mol %. Pure silver bromide is the most preferable.

The silver iodide content in the composition of the silver halide phase to be epitaxially grown on the host grain is preferably as high as possible. The silver halide phase to be epitaxially grown can be any of silver iodide, silver bromoiodide, silver bromoiodochloride, and silver iodochloride. However, it is preferably silver iodide or silver bromoiodide, and more preferably, silver iodide. When the silver halide phase is silver bromoiodide, the silver iodide (iodide ion) content is preferably 1 to 45 mol % to the silver amount in the silver halide phase to be epitaxially grown, more preferably 5 to 45 mol %, and most preferably, 10 to 45 mol %. To form misfits necessary for introducing dislocation lines, the silver iodide content is preferably as high as possible. However, 45 mol % is the solid solution limit of silver bromoiodide.

The amount of silver iodide or iodide ions added to form this high-silver-iodide-content phase to be epitaxially grown on the host grain is preferably 2 to 10 mol %, more preferably, 2 to 8 mol %, and most preferably 2 to 6 mol % of the silver amount of the host grain. From the view point that the lowering of the iodide ion content of the grains makes the solubility thereof increase, if the amount of the iodide ion added is small, the number of tabular grains with partly hollowed edges and/or corners, increases, which is preferable. However, the amount less than 2 mol % is unpreferable because dislocation lines are not easily introduced. On the other hand, if the amount is large, the number of tabular grains with partly hollowed edges and/or corners increases due to excessive conversion, which is preferable. However, if it exceeds 10 mol %, the developing speed is reduced, which is unpreferable.

At this time, amount of the high-silver-iodide-content phase is present preferably within the range of 10 to 60 mol %, more preferably, 20 to 40 mol %, of the total silver amount of the grains after completion of final grain formation. An amount less than 10 mol % or exceeding 60 mol % is unpreferable because it is difficult to increase the sensitivity obtained by the introduction of dislocation lines.

The high-silver-iodide-content phase can be formed in any portion on the host tabular grain. The phase forming, however, is preferably limited to the edge portion of the host grain.

When the high-silver-iodide-content phase is formed on the host grain in the present invention, it is preferable to use, e.g., a method of releasing iodide ions from an iodide ion-releasing agent by reacting it with an alkali or a nucleophilic agent, as described in U.S. Pat. Nos. 5,498,516 and 5,527,664. In such a case, it is possible to freely choose the composition and addition method of a halide to be added and the solvent concentration, gelatin concentration, and ionic strength of a reaction solution.

After the high-silver-iodide-content phase is epitaxially grown on the host grain, dislocation lines are introduced when a silver halide shell is formed outside the host tabular grain. Although the composition of the silver halide shell can be any of silver bromide, silver bromoiodide, and silver bromoiodochloroide, it is preferably silver bromide.

The silver amount used in the growth of the silver halide shell is preferably 10 to 60 mol %, and more preferably, 20 to 40 mol % of the total silver amount of the grains after completion of final grain formation.

In the process of introducing the dislocation lines described above, the temperature is preferably 40 to 75° C. At least a part of the step for forming a silver halide shell is preferably performed at a high temperature. Temperature control at temperatures outside the above range requires a high performance manufacturing apparatus, and this is financially unfavorable in terms of manufacturing costs.

In the above dislocation line introducing process, the pAg can preferably be any value of 11 to 7. At least a part of one the above step for forming a silver halide shell is preferably performed at a low pAg value. The pAg in such a case is preferably 8.0 or less, more preferably, 7.8 or less, and most preferably 7.6 or less.

Further, in the above dislocation line-introducing process, a silver halide solvent can also be used in combination. Examples of the solvent are ammonia, thiocyanates, thioethers, etc. However, the solvent is not limited to the above. Various concentrations of the silver halide solvent may be chosen according to necessity.

The positions and the density of dislocation lines of a tabular grain will be described below. In the case of a tabular grain, the positions and the number of dislocation lines of each grain, when viewed from a direction perpendicular to its main planes, can be obtained from photographing the grain using an electron microscope, as described above. Dislocation lines are preferably introduced into a tabular grain of the present invention, as far as possible, only in a fringe portion of a tabular grain. In the present invention, the "fringe portion" is the peripheral region of a tabular grain. More specifically, in the distribution of silver iodide from the edge to the center of a tabular grain, the fringe portion is a region outside a certain point at which the silver iodide content exceeds or becomes lower than, for the first time, the average silver iodide content of the whole grain when viewed from the edge.

In the present invention, tabular grains having preferably, 10 or more dislocation lines, more preferably, 30 or more dislocation lines per grain in the fringe portion thereof. When the dislocation lines are present densely or are observed as crossing each other, it may occur that the dislocation lines per grain cannot be accurately counted. However, in that instance, it is practicable to make approximate counting, such as about 10 dislocation lines, about 20 dislocation lines, about 30 dislocation lines, etc.

In the present invention, it is preferred, in view of inter-granular homogeneousness, that a distribution of the number of dislocation lines among the tabular grains are homogeneous. In the present invention, silver halide tabular grains each having 10 or more dislocation lines per grain in the grain fringe portion occupy at least 50%, more preferably at least 80% of the total projected area. When the rate is less than 50%, enhancing sensitivity cannot be attained easily, which is not preferable. Furthermore, in the present invention, it is more preferable that silver halide tabular grains each having 50 or more dislocation lines per grain occupy at least 50%, more preferably at least 80% of the total projected area.

When the tabular grains of the present invention have dislocation lines in grain fringe portion, the thickness of fringe portion region (depth toward grain center) is preferably in the range of 0.05 to 0.25 $\mu$m, more preferably 0.05 to 0.20 $\mu$m.

In the present invention, when it is intended to determine the ratio of grains having dislocation lines and the number of dislocation lines, the determination is preferably accomplished by directly observing dislocation lines with respect to at least 100 grains, more preferably at least 200 grains, and most preferably 300 grains.

Moreover, when the tabular grains of the present invention have dislocation lines in grain fringe portions, 50% or more (numerical ratio of grains) of all the tabular grains are preferably occupied by tabular grains wherein the average silver iodide content of the grain fringe portion is 2 mol % or more higher than that of grain central portion, more preferably by tabular grains wherein the average silver iodide content of the grain fringe portion is 4 mol % or more higher than that of grain central portion, and most preferably by tabular grains wherein the average silver iodide content of the grain fringe portion is 5 mol % or more higher than that of grain central portions. "Grain central portion" herein means the area inside the grain fringe portion.

The silver iodide content within tabular grains can be determined by, for example, the method of JP-A-7-219102 using an analytical electron microscope.

In the tabular grains of the invention, it is preferable to dope one or more photgraphically useful metal ion or complex (hereinafter referred to as metal (complex) ion) inside the grains.

The metal ion doping within silver halide grains will be described below.

The photographically useful metal (complex) ion refers to a compound employed in intra-granular doping for the purpose of improving the photographic characteristics of lightsensitive silver halide emulsion. This compound functions as a transient or permanent trap for electrons or positive holes in silver halide crystals, and exerts such effects as high sensitivity, high contrast, improvement of reciprocity law characteristics and improvement of pressure characteristics.

As the metal for use in doping within emulsion grains in the present invention, there can preferably be employed the first to third transition metal elements such as iron, ruthenium, rhodium, palladium, cadmium, rhenium, osmium, iridium, platinum, chromium and vanadium and further amphoteric metal elements such as gallium, indium, thallium and lead. These metal ions are doped in the form of a complex salt or a single salt. With respect to the complex ion, a six-coordinate halogeno or cyano complex containing halide ion or cyanide (CN) ion as a ligand is preferably used.

Also, use can be made of a complex having a nitrosyl (NO) ligand, a thionitrosyl (NS) ligand, a carbonyl (CO) ligand, a thiocarbonyl (NCO) ligand, a thiocyanato (NCS) ligand, a selenocyanato (NCSe) ligand, a tellurocyanato (CNTe) ligand, a dinitrogen ($N_2$) ligand, an azido ($N_3$) ligand or an organic ligand such as a bipyridyl ligand, a cyclopentadienyl ligand, a 1,2-dithiolenyl ligand or an imidazolyl ligand. The following polydentate ligands may be used as the ligand. That is, use may be made of any of bidentate ligands such as a bipyridyl ligand, tridentate ligands such as diethylenetriamine, tetradentate ligands such as triethylenetetramine and hexadentate ligands such as ethylenediaminetetraacetic acid. The coordination number is preferably 6, but may be 4. With respect to the organic ligand, those described in U.S. Pat. Nos. 5,457,021, 5,360, 712 and 5,462,849, the disclosures of which are incorporated herein by reference, can preferably be employed. Further, it is also preferred to incorporate the metal ion in the form of an oligomer.

When the metal (complex) ion is incorporated in a silver halide, it is important whether the size of metal (complex) ion is suitable to the lattice spacing of silver halide. Further, that a compound with the silver or halide ion of the metal (complex) ion is co-precipitated together with the silver halide is essential for the doping of the silver halide with the metal (complex) ion. Accordingly, it is required that the pKsp (common logarithm of inverse number of solubility product) of the compound with the silver or halide ion of the metal (complex) ion be approximately equal to the pKsp (silver chloride 9.8, silver bromide 12.3, and silver iodide 16.1) of silver halide. Therefore, the pKsp of the compound with the silver or halide ion of the metal (complex) ion is preferably in the range of 8 to 20.

The amount of metal complex with which silver halide grains are doped is generally in the range of $10^{-9}$ to $10^{-2}$ mol per mol of silver halide. Specifically, the amount of metal complex which provides a transient shallow electron trap in the photo-stage is preferably in the range of $10^{-6}$ to $10^{-2}$ mol per mol of silver halide. On the other hand, the metal complex which provides a deep electron trap in the photo-stage is preferably used in an amount of $10^{-9}$ to $10^{-5}$ mol, per mol of silver halide.

The content of metal (complex) ion in emulsion grains can be determined by the atomic absorption, polarized Zeeman spectroscopy and ICP analysis. The ligand of metal complex ion can be identified by the infrared absorption (especially, FT-IR).

The doping of silver halide grains with the above metal (complex) ion can be effected at any of a grain surface phase, an internal phase and a surface phase which is extremely shallow to such an extent that surface exposure of metal ions is inhibited (known as "subsurface") as described in U.S. Pat. Nos. 5,132,203 and 4,997,751. Selection may be made in conformity with the intended use. Further, a plurality of metal ions may be used in the doping. These may be used to dope a single phase, or phases which are different from each other. The method of adding such a compound may be one comprising mixing an intended metal salt solution with an aqueous solution of halide or an solution of water-soluble silver salt at the time of grain formation, or may be one comprising directly adding the intended metal salt solution. Also, the method may comprise adding silver halide emulsion fine grains doped with the intended metal ion. When the metal salt is dissolved in water or an appropriate solvent such as methanol or acetone, in order to stabilize the solution, it is preferred to employ a method wherein an aqueous solution of hydrogen halide (for example, HCl or HBr), thiocyanic acid or its salt, or an alkali halide (for example, KCl, NaCl, KBr or NaBr) is added. Further, adding an acid, an alkali or the like according to necessity is preferred from the same viewpoint.

When emulsion grains are doped with a metal ion of cyano complex, it may occur that the cyano complex reacts with gelatin to thereby generate cyan, which inhibits gold sensitization. In that instance, as described in, for example, JP-A-6-308653, it is preferred to add thereto a compound capable of inhibiting the reaction between gelatin and cyano complex. For example, it is preferred that the process after the doping with the metal ion of cyano complex be carried out in the presence of a metal ion capable of forming a coordinate bond with gelatin, such as, for example, zinc ion.

It is preferable that the emulsion of the present invention be chemically sensitized using a tellurium sensitizer.

Next, the tellurium sensitizer will be explained. The emulsion of the present invention is preferably chemically sensitized using a tellurium sensitizer. Examples of the tellurium sensitizer are known tellurium sensitizers described in U.S. Pat. Nos. 1,623,499, 3,320,069, and 3,772,031, British Patents 235,211, 1,121,496, 1,295,462, and 1,396,696, Canada Patent 800,958, Jpn. Pat. Appln. KOKAI Publication No. (hereinafter referred to as JP-A) 8-95184, Journals of Chemical Society Chemical Communication 635 (1980), 1102 (1979), and 645 (1979), Journal of Chemical Society Perkin Transaction 1, 2191 (1980), edited by S. Patai, The Chemistry of Organic Selenium and Tellurium Compounds, Vol 1 (1986), and Vol 2 (1987). Of the above tellurium sensitizers, the compounds represented by the following general formulae (I), (II) or (III) are preferable.

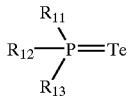

In the formula, $R_{11}$, $R_{12}$ and $R_{13}$ independently represent an aliphatic group, an aromatic group, a heterocyclic group, $OR_{14}$, $NR_{15}(R_{16})$, $SR_{17}$, $OSiR_{18}(R_{19})$ $(R_{20})$, X or a hydrogen atom. $R_{14}$ and $R_{17}$ independently represent an aliphatic group, an aromatic group, a heterocyclic group, a hydrogen atom, or a cation. $R_{15}$ and $R_{16}$ represent an aliphatic group, an aromatic group, a heterocyclic group or a hydrogen atom. $R_{18}$, $R_{19}$ and $R_{20}$ represent an aliphatic group, and X represents a halogen atom.

In formula (I), the aliphatic group represented by $R_{11}$, $R_{12}$, $R_{13}$, $R_{14}$, $R_{15}$, $R_{16}$, $R_{17}$, $R_{18}$, $R_{19}$ and $R_{20}$ preferably has 1–30 carbon atoms. In particular, it is preferably a straight-chain, branched, or cyclic alkyl group, alkenyl group, alkynyl group, and aralkyl group, each having 1–20 carbon atoms. Examples of the alkyl group, alkenyl group, alkynyl group and aralkyl group are methyl, ethyl, n-propyl, isopropyl, t-butyl, n-octyl, n-decyl, n-hexadecyl, cyclopenthyl, cyclohexyl, allyl, 2-butenyl, 3-pentenyl, propargyl, 3-pentinyl, benzyl, and phenethyl.

In formula (I), the aromatic group represented by $R_{11}$, $R_{12}$, $R_{13}$, $R_{14}$, $R_{15}$, $R_{16}$, and $R_{17}$ preferably has 6–30 carbon atoms. In particular, it is preferably a monocyclic, or condensed-ring aryl group having 6–20 carbon atoms, such as phenyl and naphthyl.

In formula (I), the heterocyclic group represented by $R_{11}$, $R_{12}$, $R_{13}$, $R_{14}$, $R_{15}$, $R_{16}$, and $R_{17}$ is preferably a saturated or unsaturated heterocyclic group of a 3- to 10-membered ring which contains at least one of a nitrogen atom, an oxygen atom, and a sulfur atom. The heterocyclic group may be monocyclic or may form a condensed ring with another aromatic ring or heterocyclic ring. The heterocyclic group is preferably a 5- to 6-membered aromatic heterocyclic ring. Examples are pyridyl, furyl, thienyl, thiazolyl, imidazolyl andbenzimidazolyl.

In formula (I), the cation represented by $R_{14}$ and $R_{17}$ is an alkali metal or ammonium.

In formula (I), the halogen atom represented by X is, for example, a fluorine atom, a chlorine atom, a bromine atom, and an iodine atom. The aliphatic group, aromatic group and heterocyclic group may be substituted. Examples of the substituent are the following groups. Representative examples of the substituents are an alkyl group, aralkyl group, alkenyl group, alkynyl group, aryl group, alkoxy group, aryloxy group, amino group, acylamino group, ureide group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoramide group, diacylamino group, imide group, alkylthio group, arylthio group, halogen atom, cyano group, sulfo group, carboxy group, hydroxy group, phosphono group, nitro group, and heterocyclic group. These groups can be further substituted. If two or more substituents exist, these substituents can be the same or different. Two of $R_{11}$, $R_{12}$ and $R_{13}$ can be bonded to each other to form a ring, together with the phosphorus atom. $R_{15}$ and $R_{16}$ can be bonded to form a nitrogen-containing heterocyclic ring. In formula (I), $R_{11}$, $R_{12}$ and $R_{13}$ preferably represent an aliphatic group or aromatic group, more preferably an alkyl group or aromatic group.

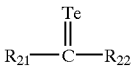

In formula (II), $R_{21}$ represents an aliphatic group, an aromatic group, a heterocyclic group, or —$NR_{23}(R_{24})$. $R_{22}$ represents an aliphatic group, an aromatic group, a heterocyclic group, or —$NR_{25}(R_{26})$, —$N(R_{27})N(R_{28})R_{29}$, or —$OR_{30}$. $R_{23}$, $R_{24}$, $R_{25}$, $R_{26}$, $R_{27}$, $R_{28}$, $R_{29}$ and $R_{30}$ represent independently a hydrogen atom, an aliphatic group, an aromatic group, a heterocyclic group, or an acyl group. $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ can be bonded to each other to form a ring.

Next, formula (II) will be explained in detail. In formula (II), the aliphatic group, aromatic group, and heterocyclic group represented by $R_{21}$, $R_{22}$, $R_{23}$, $R_{24}$, $R_{25}$, $R_{26}$, $R_{27}$, $R_{28}$, $R_{29}$ and $R_{30}$ have the same meaning as those in formula (I).

In formula (II), the acyl group represented by $R_{23}$, $R_{24}$, $R_{25}$, $R_{26}$, $R_{27}$, $R_{28}$, $R_{29}$ and $R_{30}$ preferably has 1–30 carbon atoms. In particular, it is preferably a straight-chain or branched acyl group having 1–20 carbon atoms, such as acetyl, benzoyl, formyl, pivaloyl, and decanoyl. In a case where $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ are bonded to form a ring, examples are an alkylene group, arylene group, aralkylene group, alkenylene group, etc. These aliphatic, aromatic, and heterocyclic groups can be substituted by the substituents mentioned above as the substituents in formula (I).

In formula (II), $R_{21}$ preferably represents an aliphatic group, an aromatic group, or —$NR_{23}(R_{24})$. $R_{22}$ represents —$NR_{25}(R_{26})$. $R_{23}$, $R_{24}$, $R_{25}$, and $R_{26}$ represent an aliphatic group, or an aromatic group. In formula (II), $R_{21}$ represents, more preferably, an aromatic group, or —$NR_{23}(R_{24})$, and $R_{22}$ represents —$NR_{25}(R_{26})$. $R_{23}$, $R_{24}$, $R_{25}$ and $R_{26}$ represent an alkyl group or an aromatic group. It is also more preferable that $R_{21}$ and $R_{25}$, and $R_{23}$ and $R_{25}$ form a ring through an alkylene group, arylene group, aralkylene group, or alkenylene group.

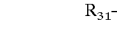

In formula (III), $R_{31}$ and $R_{32}$ can be the same or different, and represent an aliphatic group, an aromatic group, a heterocyclic group, or —(C═Y')—$R_{33}$. $R_{33}$ represents a hydrogen atom, an aliphatic group, an aromatic group, a heterocyclic group, $NR_{34}(R_{35})$, $OR_{36}$, or $SR_{37}$. Y' represents an oxygen atom, a sulfur atom, or C═Y' represents $CN(R_{38})$. $R_{34}$, $R_{35}$, $R_{36}$, $R_{37}$, and $R_{38}$ represent a hydrogen atom, an aliphatic group, an aromatic group, or a heterocyclic group, and n represents 1 or 2.

Next, formula (III) will be explained in detail. In formula (III), the aliphatic group, aromatic group, or heterocyclic group represented by $R_{31}$, $R_{32}$, $R_{33}$, $R_{34}$, $R_{35}$, $R_{36}$, $R_{37}$, and $R_{38}$ are equivalent to those in formula (I). The aliphatic group, aromatic group and heterocyclic group represented by $R_{31}$, $R_{32}$, $R_{33}$, $R_{34}$, $R_{35}$, $R_{36}$, $R_{37}$, and $R_{38}$ can be substituted by the substituents mentioned above as the substituents in formula (I). $R_{31}$ and $R_{32}$, and $R_{34}$ and $R_{35}$ can be bonded to each other to form a ring.

In formula (III), $R_{31}$ and $R_{32}$ preferably represent a heterocyclic group, or —(C═Y')—$R_{33}$. $R_{33}$ represents $NR_{34}(R_{35})$ or $OR_{36}$, and Y' represents an oxygen atom. $R_{34}$, $R_{35}$, and $R_{36}$ represent an aliphatic group, an aromatic group or a heterocyclic group. In formula (III), $R_{31}$ and $R_{32}$ represent, more preferably, —(C═Y')—$R_{33}$. $R_{33}$ represents $NR_{34}(R_{35})$, and Y' represents an oxygen atom. $R_{34}$ and $R_{35}$ represent an aliphatic group, an aromatic group, or a heterocyclic group.

Specific examples of the tellurium sensitizer represented by formulae (I), (II) and (III) are compounds in (Cnem 22)-(Chem 36) in JP-A-8-95184, the disclosure of which in incorporated herein by reference.

The amount of tellurium sensitizer to be used varies according to the silver halide grain to be used, chemical ripening conditions, etc. In general, $10^{-8}$ to $10^{-2}$ mol, more preferably $10^{-8}$ to $5\times10^{-3}$ mol, per mol of silver halide is used.

The conditions of chemical sensitization using the tellurium sensitizer of the present invention are not especially limited. The pH is 5 to 8, the pAg is 6 to 11, and preferably 7 to 10, the temperature is 40 to 95° C., and preferably 45° C. to 85° C. The timing of addition of the tellurium sensitizer is not limited, but it is preferably after the addition of a spectral sensitization dye.

The amount of silver to be applied (the amount of silver halide in terms of silver) in the emulsion is 0.3 to 1.5 g/m$^2$, and preferably 0.5 to 1.2 g/m$^2$.

Emulsions of the present invention and other photographic emulsions that can be used together with the emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the discloses of which are herein incorporated by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously.

In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added, a plurality of soluble halogen salts of different solution compositions are to be added or a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of a silver salt and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to 1×10–7 mol, and more preferably, $1\times10^{-5}$ to $5\times10^{-7}$ mol per mol of a silver halide. A preferable amount of a palladium compound is $1\times10^{-5}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, or during chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted. Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, $Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus.

These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide. In the case where a preferable silver halide grain size of 0.2 to 1.2 $\mu$m, the addition amount of about $5\times10^{-5}$ to $2\times10^{-3}$ is effective.

The lightsensitive material of the present invention, it is only required that at least one silver halide emulsion layer be formed on a support, and it is preferable to provide at least three lightsensitive layers imparted with three different lightsensitive regions. A typical example is a silver halide photographic lightsensitive material having, on its support, at least three lightsensitive layers each constituted by a plurality of silver halide emulsion layers which are sensitive to essentially the same color but have different speeds. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Various non lightsensitive layers such as an intermediate layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference. In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

Furthermore, in the present invention, the photographic material may also have an emulsion layer having the fourth or more color sensitivity.

The layer of the fourth or more color sensitivity may be a layer that is sensitive to the wavelength region partly different from the region of a blue-sensitive, green-sensitive or red-sensitive layer. The layer of the fourth or more color sensitivity may be sensitive to infrared light or ultraviolet light. Couplers to be used in the layers may be selected depending on the purpose thereof.

The layer structures of the photographic material of the present invention are listed below when the photographic material of the present invention is configured to a three-layer structure. However, the present invention is not limited to these. The order herein is from the layer closest to the support.

1) low-speed red-sensitive emulsion layer (RLu), medium-speed red-sensitive emulsion layer (RLm), high-speed red-sensitive emulsion layer (RLo), low-speed green-sensitive emulsion layer (GLu), medium-speed green-sensitive emulsion layer (GLm), high-speed green-sensitive emulsion layer (GLo), low-speed blue-sensitive emulsion layer (Blu), medium-speed blue-sensitive emulsion layer (BLm), and high-speed blue-sensitive emulsion layer (BLo).
2) GLu, GLm, GLo, RLu, RLm, RLo, BLu, BLm, and Blo;
3) GLu, RLu, GLm, RLm, GLo, RLo, BLu, BLm, Blo;
4) GLu, GLm, RLu, RLm, GLo, RLO, BLu, BLm, Blo;
5) RLu, RLm, GLu, GLm, GLo, RLo, BLu, BLm, Blo;
6) GLu, RLu, RLm, GLm, GLo, RLo, BLu, BLm, Blo;
7) RLu, GLu, RLm, GLm, GLo, RLo, BLu, BLm, Blo;
8) GLu, GLm, RLm, RLu, RLo, GLo, BLu, BLm, Blo;
9) RLu, GLm, GLu, RLm, RLo, GLo, BLu, BLm, Blo;
9) RLu, RLm, GLu, GLm, RLo, GLo, BLu, BLm, Blo;
10) GLu, GLm, RLu, RLm, RLo, GLo, BLu, BLm, Blo;
11) RLu, GLu, GLm, RLm, RLo, GLo, BLu, BLm, Blo; and
12) GLu, RLu, GLm, RLm, RLo, GLo, BLu, BLm, Blo.

The silver halide preferably used in the present invention is silver bromoiodide, silver iodochloride, or silver bromochloroiodide containing about 30 mol % or less of silver iodide. A particularly preferable silver halide is silver bromoiodide or silver bromochloroiodide containing about 2 to about 10 mol % of silver iodide.

Silver halide grains contained in the photographic emulsion can have regular crystals such as cubic, octahedral, or tetradecahedral crystals, irregular crystals such as spherical or tabular crystals, crystals having crystal defects such as twin planes, or composite shapes thereof.

The silver halide grain can be a fine grain having a grain size of about 0.2 4 $\mu$m or less, or be a large grain having a projected area diameter of upto about 10 4 $\mu$m, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, "I. Emulsion preparation and types", and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table to be presented later.

In a lightsensitive material of the present invention, it is possible to mix, in a single layer, two or more types of emulsions different in at least one of characteristics of a photosensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably, 0.02 to 0.2 $\mu$m.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a lightsensitive material of the present invention is preferably 6.0 g/m$^2$ or less, and most preferably, 4.5 g/m$^2$ or less.

Photographic additives usable in the present invention are also described in RD's, the disclosures of which are incorporated herein by reference, and the relevant portions are summarized in the following table.

| Types of Additives | RD17643 | RD18716 | RD307105 |
|---|---|---|---|
| 1. Chemical sensitizers | page 23 | page 648 right column | page 866 |
| 2. Sensitivity increasing agents | | page 648 right column | |

-continued

| Types of Additives | RD17643 | RD18716 | RD307105 |
|---|---|---|---|
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surfactants | pages 26–27 | page 650, right column | pages 875–876 |
| 9. Antistatic agents | page 27 | page 650, right column | pages 876–877 |
| 10. Matting agents | | | pages 878–879. |

Various dye forming couplers can be used in the light-sensitive material of the present invention, and the following couplers are particularly preferable.

Yellow couplers: couplers represented by formulas (I) and (II) in EP No. 502,424A; couplers represented by formulas (1) and (2) in EP No. 513,496A (particularly Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (particularly D-35 on page 18); couplers represented by formula (Y) on page 4 in EP No. 447,969A1 (particularly Y-1 (page 17) and Y-54 (page 41)); and couplers represented by formulas (II) to (IV) in column 7, lines 36 to 58, in U.S. Pat. No. B4,476,219 (particularly II-17, II-19 (column 17), and II-24 (column 19)), the disclosures of the above documents disclosing the yellow couplers are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and -75 (page 139) in EP No. 456,257; M-4 and -6 (page 26), and M-7 (page 27) in EP No. 486,965; M-45 (page 19) in EP No. 571,959A; (M-1) (page 6) in JP-A-5-204106; and M-22 in paragraph 0237 of JP-A-4-362631, the disclosures of the above documents disclosing the magenta couplers are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by general formulas (Ia) and (Ib) in claim 1 of JP-A-6-67385, the disclosures of the above documents disclosing the cyan couplers are incorporated herein by reference.

Polymer couplers: P-1 and P-5 (page 11) in JP-A-2-44345, the disclosure of which is incorporated herein by reference.

Couplers for forming a colored dye with a proper diffusibility are preferably those described in U.S. Pat. No. 4,366,237, GB No. 2,125,570, EP No. 96,873B, and DE No. 3,234,533, the disclosures of which are incorporated herein by reference.

As couplers for correcting the unnecessary absorption of a colored dye, preferred use is made of, besides the magenta colored yellow couplers of the present invention, yellow colored cyan couplers represented by formulas (CI), (CII), (CIII), and (CIV) described on page 5 in EP No. 456,257A1 (particularly YC-86 on page 84); yellow colored magenta couplers ExM-7 (page 202), Ex-1 (page 249), and EX-7 (page 251) described in EP No. 456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers represented by formula (A) in claim 1 of WO No. 92/11575 (particularly compound examples on pages 36 to 45), the disclosures of all the documents disclosing the couplers for correcting the unnecessary absorption of a colored dye are incorporated herein by reference.

Examples of couplers that release a photographically useful group are as follows. Development inhibitor release compounds: compounds represented by formulas (I), (II), (III), and (IV) on page 11 of EP No. 378,236A1 (particularly T-101 (page 30), T-104 (page 31), T-113 (page 36), T-131 (page 45), T-144 (page 51), and T-158 (page 58)); a compound represented by formula (I) on page 7 of EP No. 436,938A2 (particularly D-49 (page 51)); a compound represented by formula (1) in EP No. 568,037A (particularly (23) (page 11)); and compounds represented by formulas (I), (II), and (III) on pages 5 and 6 of EP No. 440,195A2 (particularly I-(1) on page 29). Bleaching accelerator release compounds: compounds represented by formulas (I) and (I') on page 5 of EP No. 310,125A2 (particularly (60) and (61) on page 61); and compounds represented by formula (I) in claim 1 of JP-A-6-59411 (particularly (7) (page 7)). Ligand release compounds: compounds represented by LIG-X described in claim 1 of U.S. Pat. No. 4,555,478 (particularly compounds in column 12, lines 21 to 41). Leuco dye release compounds: compounds 1 to 6 in columns 3 to 8 of U.S. Pat. No. 4,749,641. Fluorescent dye release compounds: compounds represented by COUP-DYE in claim 1 of U.S. Pat. No. 4,774,181 (particularly compounds 1 to 11 in columns 7 to 10). Development accelerator or fogging agent release compounds: compounds represented by formulas (1), (2), and (3) in column 3 of U.S. Pat. No. 4,656,123 (particularly (I-22) in column 25); and ExZK-2 on page 75, lines 36 to 38, in EP No. 450,637A2. Compounds which release a group which does not function as a dye unless it splits off: compounds represented by formula (I) in claim 1 of U.S. Pat. No. 4,857,447 (particularly Y-1 to Y-19 in columns 25 to 36).

Preferable examples of additives other than couplers are as follows.

Dispersion mediums of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272. Impregnating latexes of an oil-soluble organic compound: latexes described in U.S. Pat. No. 4,199,363. Scavengers of developing agent in an oxidized form: compounds represented by formula (I) in column 2, lines 54 to 62, in U.S. Pat. No. 4,978,606 (particularly I-(1), I-(2), I-(6), and I-(12) (columns 4 and 5)), and formulas in column 2, lines 5 to 10, in U.S. Pat. No. 4,923,787 (particularly compound 1 (column 3)). Stain inhibitors: formulas (I) to (III) on page 4, lines 30 to 33, particularly I-47, I-72, III-1, and III-27 (pages 24 to 48) in EP No. 298321A. Discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP No. 298,321A; II-1 to III-23, particularly III-10, in columns 25 to 38 of U.S. Pat. No. 5,122,444; I-1 to III-4, particularly II-2, on pages 8 to 12 in EP No. 471,347A; and A-1 to A-48, particularly A-39 and A-42, in columns 32 to 40 of U.S. Pat. No. 5,139,931. Materials which reduce the use amount of a color enhancer or a color amalgamation inhibitor: I-1 to II-15, particularly I-46, on pages 5 to 24 in EP No. 411,324A. Formalin scavengers: SCV-1 to SCV-28, particularly SCV-8, on pages 24 to 29 in EP No. 477,932A. Film hardeners: H-1, H-4, H-6, H-8, and H-14 on page 17 in JP-A-1-214845; compounds (H-1 to H-54) represented by formulas (VII) to (XII) in columns 13 to 23 of U.S. Pat. No. 4,618,573;, compounds (H-1 to H-76), particularly H-14, represented by formula (6) on page 8, lower right column, in JP-A-2-214852; and compounds described in claim 1 of U.S. Pat. No. 3,325,287. Development inhibitor precursors: P-24, P-37, and P-39 (pages 6 and 7) in JP-A-62-168139; and compounds described in claim 1, particularly 28 and 29 in column 7, of U.S. Pat. No. 5,019,492. Antiseptic agents and mildewproofing agents; I-1 to III-43, particularly II-1, II-9, II-10, II-18, and III-25, in columns 3 to 15 of U.S. Pat. No. 4,923,790. Stabilizers and antifoggants: I-1 to (14), particularly I-1, I-60, (2), and (13), in columns 6 to 16 of U.S. Pat. No. 4,923,793; and compounds 1 to 65, particularly compound 36, in columns 25 to 32 of U.S. Pat. No. 4,952,483. Chemical sensitizers: triphenylphosphine, selenide, and compound 50 in JP-A-5-40324. Dyes: a-1 to b-20, particularly a-1, a-12, a-18, a-27, a-35, a-36, and b-5, on pages 15 to 18 and V-1 to V-23, particularly V-1, on pages 27 to 29 in JP-A-3-156450; F-I-1 to F-II-43, particularly F-I-11 and F-II-8, on pages 33 to 55 in EP No. 445,627A; III-1 to III-36, particularly III-1 and III-3, on pages 17 to 28 in EP No. 457,153A; microcrystalline dispersions of Dye-1 to Dye-124 on pages 8 to 26 in WO No. 88/04794; compounds 1 to 22, particularly compound 1, on pages 6 to 11 in EP No. 319,999A; compounds D-1 to D-87 (pages 3 to 28) represented by formulas (1) to (3) in EP No. 519,306A; compounds 1 to 22 (columns 3 to 10) represented by formula (I) in U.S. Pat. No. 4,268,622; and compounds (1) to (31) (columns 2 to 9) represented by formula (I) in U.S. Pat. No. 4,923,788. UV absorbents: compounds (18b) to (18r) and 101 to 427 (pages 6 to 9) represented by formula (1) in JP-A-46-3335; compounds (3) to (66) (pages 10 to 44) represented by formula (I) and compounds HBT-1 to HBT-10 (page 14) represented by formula (III) in EP No. 520,938A; and compounds (1) to (31) (columns 2 to 9) represented by formula (1) in EP No. 521,823A.

The present invention can be applied to various color lightsensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

In the lightsensitive material of the present invention, the total of film thicknesses of all hydrophilic colloid layers on the side having emulsion layers is preferably 28 $\mu$m or less, more preferably 23 $\mu$m or less, still more preferably 18 $\mu$m or less, and most preferably 16 $\mu$m or less. Film swelling speed $T_{1/2}$ is preferably 30 sec or less, more preferably 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

[maximum swollen film thickness-film thickness]/film thickness.

In the lightsensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The lightsensitive material of the present invention can be developed by conventional methods described in RD. No. 17643, pages 28 and 29; RD. No. 18716, page 651, left to right columns; and RD No. 307105, pages 880 and 881, but the lightsensitive material of the present invention it characterized in that is can be processed rapidly.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di (sulfoehtyl)hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, more preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the lightsensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining sensitivity to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

W: amount of bromide ion leached from the lightsensitive material into the color developing solution when a color development of 1 $m^2$ of the lightsensitive material has been carried out (mol), and V: amount of color developing replenisher supplied per $m^2$ of the lightsensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used for means for enhancing sensitivity when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A's-4-251845, and 4-268552, EP Nos. 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V_1+V_2)/V_1+C_p$$

$C_R$: concentration of each component in the replenisher,
$C_T$: concentration of the component in the mother liquor (processing tank solution),
$C_p$: component concentration consumed during processing,
$V_1$: amount of replenisher having bleaching capability supplied per $m^2$ of lightsensitive material (mL), and
$V_2$: amount carried from previous bath by 1 $m^2$ of lightsensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the lightsensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the bleach ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the lightsensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP Nos. 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the lightsensitive material.

The replenishing amount of water washing and stabilizing solutions is preferably in the range of 80 to 1000 mL, more preferably 100 to 500 mL, and much more preferably 150 to 300 mL, per $m^2$ of the lightsensitive material from the viewpoint that water washing and stabilizing functions are ensured and that the amount of waste solution is reduced to contribute to environment protection. In the processing with the above replenishing amount, any of known mildewproofing agents such as thiabenzazole, 1,2-benzoisothiazolin-3-one and 5-chloro-2-methylisothiazolin-3-one and antibiotics such as gentamicin is preferably added, or water deionized by the use of, for example, an ion exchange resin is preferably used, for preventing the breeding of bacteria and mildew. The use of deionized water in combination with a mildewproofing agent and an antibiotic is more effective than individual uses.

With respect to the solution placed in the water washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used in the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably harvested from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out the present invention are described on page 5, right column, line 11 to page 7, right column, last line of the above journal of technical disclosure.

The processing agent for use in the present invention may be supplied in any form, for example, a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A-51-61837 and JP-A-6-102628 and a paste processing agent in PCT National Publication 57-500485. Although any of these can be suitably used, from the viewpoint of easiness in use, it is preferred to employ a liquid prepared in the same concentration as in use in advance.

The container for storing the above processing agent is composed of, for example, any one or a mixture of polyethylene, polypropylene, polyvinyl chloride, polyethylene terephthalate and nylon. A selection is made in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 $\mu$m so that the oxygen permeability therethrough is 20 mL/m$^2$.24hrs.atm or less.

The processing solution for color reversal film to be employed in the present invention will be described below.

With respect to the processing for color reversal film, detailed descriptions are made in Public Technology No. 6 (Apr. 1, 1991) issued by Aztek, page 1, line 5 to page 10, line 5 and page 15, line 8 By to page 24, line 2, any of which can be preferably applied thereto.

In the color reversal film processing, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution and washing water made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

The magnetic recording layer for use in the present invention will be described below.

The magnetic recording layer is obtained by coating on a support with a water-base or organic solvent coating liquid having magnetic material grains dispersed in a binder.

Suitable magnetic material grains can be composed of any of ferromagnetic iron oxides such as $\gamma$ $Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 m$^2$/g, more preferably at least 30 m$^2$/g in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average olecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support for use in the present invention will be described below. Particulars thereof together with the below mentioned lightsensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The lightsensitive material of the invention may have a subbing layer on at least one of the emulsion layer side and the back side. The subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, SiO2, TiO2, inorganic fine grains or polymethyl methacrylate copolymer fine grains (0.01 to 10 $\mu$m) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω.cm or less, preferably $10^5$ Ω.cm or less, and having a grain size of 0.001 to 1.0 $\mu$m or a composite oxide thereof (Sb, P, B, In, S, Si, C, etc.) and fine grains of sol form metal oxides or composite oxides thereof. The content thereof in the lightsensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the light-sensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably Fuji Film SUPER FA8])

(6) Collation and shipment (the cartridge and the index print are collated by an ID number and shipped together with the prints)

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLES

Examples of the present invention will be set forth below, however the present invention is not limited to the examples.

Gelatin-1 to gelatin-4 used as dispersion media in emulsion preparations described below have the following attributes.

Gelatin-1: Common alkali-processed ossein gelatin made from bovine bones. No —$NH_2$ groups in the gelatin were chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ groups in the gelatin were chemically modified.

All of gelatin-1 to gelatin-4 described above were deionized and so adjusted that the pH of an aqueous 5% solution at 35° C. was 6.0.

(Preparation of Emulsions)

(Preparation of emulsion A-1)

1,200 mL of an aqueous solution containing 0.9 g of KBr and 3.6 g of gelatin-4 described above was stirred at 35° C. (1st solution preparation). 86 mL of an aqueous solution Ag-1 (containing 6.0 g of $AgNO_3$ in 100 mL), 86 mL of an aqueous solution X-1 (containing 4.9 g of KBr in 100 mL), and 20 mL of an aqueous solution G-1 (containing 2.0 g of gelatin-4 described above in 100 mL) were added over 45 sec at fixed flow rates by the triple jet method (addition 1). After that, 2.0 g of KBr were added, and the temperature was raised to 75° C. After a ripening step was performed for 10 min, 300 mL of an aqueous solution G-2 (containing 12 g of gelatin-3 described above in 100 mL) were added.

Next, 157 mL of an aqueous solution Ag-2 (containing 22.1 g of $AgNO_3$ in 100 mL) and an aqueous solution X-2 (containing 15.5 g of KBr in 100 mL) were added over 10 min by the double jet method. The flow rate of the aqueous solution Ag-2 during the addition was accelerated such that the final flow rate was 3 times the initial flow rate. Also, the aqueous solution X-2 was so added that the pAg of the bulk emulsion solution in the reaction vessel was held at 8.1 (addition 2). Subsequently, 329 mL of an aqueous solution Ag-3 (containing 32.0 g of $AgNO_3$ in 100 mL) and an aqueous solution X-3 (containing 21.5 g of KBr and 1.5 g of KI in 100 mL) were added over 20 min by the double jet method. The flow rate of the aqueous solution Ag-3 during the addition was accelerated such that the final flow rate was 2 times the initial flow rate. Also, the aqueous solution X-3 was so added that the pAg of the bulk emulsion solution in the reaction vessel was held at 8.3 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 12 min by the double jet method. The addition of the aqueous solution Ag-4 was performed at a fixed flow rate. The addition of the aqueous solution X-4 was so performed that the pAg of the bulk emulsion solution in the reaction vessel was held at 7.7 (addition 4). Thereafter, 200 mL of an aqueous G-3 solution (containing 10 g of gelatin in 100 mL) was added.

After the temperature was decreased to 55° C., an aqueous solution containing 0.048 mole of sodium p-iodoasetoamidebenzensulfonate, which is an iodide ion-releasing agent, was added, then 80 mL of a 0.8 M aqueous solution of sodium sulfite was added over 1 min at a fixed rate, and the iodide ions were caused to generate while pH is controlled to 9.0. Seven minutes after that the pH was returned to 5.6 (addition 5). One minute after that, sodium benzenethiosulfonate and $K_2IrCl_6$ were added in a form of a solution in an amount of $4\times10^{-6}$ mol/mol Ag and $8\times10^{-8}$ mol/mol Ag, respectively. One minute after that, 249 mL of the aqueous solution Ag-4 and the aqueous solution X-5 (containing 22.4 g of KBr and $2\times10^{31\ 5}$ mol of $[Ru(trz)_6]^{-}$ $_4$(trz=1,2,4-triazole) in 100 mL) were added by a double jet method over 12 min. The addition of the aqueous solution Ag-4 was performed at a fixed flow rate. The addition of the aqueous solution X-5 was performed such that the pAg of the bulk emulsion solution in the reaction vessel was held at 7.4, and the final pAg was adjusted to 9.2 (addition 6). After that, desalting was performed by normal flocculation. Water, NaOH, and gelatin-1 described above were added under stirring, and the pH and the pAg were adjusted to 6.4 and 8.6, respectively, at 56° C.

The thus obtained emulsion was occupied by silver iodobromide tabular grains whose parallel main planes ware (111) planes, in an amount of 99% or more of the total projected area.

Subsequently, sensitizing dyes Exs-1 to Exs-3 set forth below, and potassium thiocyanate, chloroauric acid, sodium thiosulfate and N,N-dimethylselenourea were subsequently added, thereby optimum chemical sensitization was performed. After that, water-soluble mercapto compounds MER-1 and MER-2 set forth below were added at a ratio of 4:1 such that the total amount was $4.3\times10^{-4}$ mol per mol of a silver halide, to terminate a chemical sensitization (chemical sensitization). Optimal chemical sensitization herein means the maximum sensitivity is obtained by exposure to light for 1/100 sec.

Sensitizing Dye for Green-sensitive Emulsion Exs-1

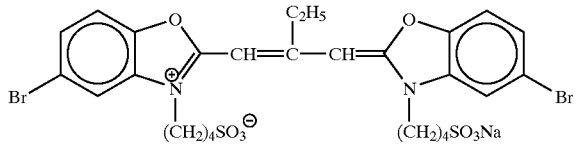

Sensitizing Dye for Green-sensitive Emulsion Exs-2

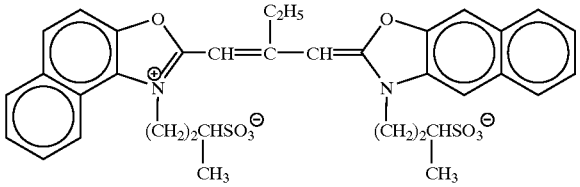

Sensitizing Dye for Green-sensitive Emulsion Exs-3

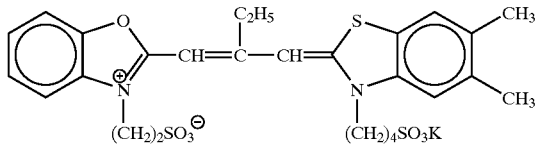

Sensitizing Dyes used in Green-sensitive Emulsions are a Mixture of Exs-1: Exs-2: Exs-3=77:20:3 in a Molar Ratio

MER-1

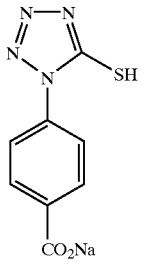

MER-2

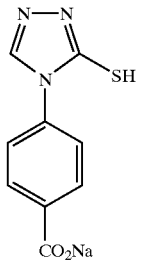

Emulsion 1-B

Emulsion 1-B was prepared following the same procedures as for emulsion 1-A except that (addition 3) was changed as follows. As the aqueous solution X-3, the solution (containing 21.5 g of KBr and 1.5 g of KI in 100 mL) was used instead of the solution (containing 22.6 g of KBr in 100 mL).

Emulsions 1-C to 1-G

In the preparation of emulsion 1-A, the pAg of (addition 2) was held at 8.4, instead of 8.1, and the pAg of (addition 3) was held at 8.4, instead of 8.3. Thereby, a base grain emulsion in which the equivalent circle diameter of grains are large and the thickness of the grains is thin was prepared. After that, (addition 5) and the following procedures were carried out as follows to prepare tabular grain emulsions 1-C to 1-G.

Emulsion 1-C was prepared following the same procedures as for emulsion 1-A except that (addition 5) was changed as follows. An aqueous solution containing sodium p-iodoacetamidobenzenesulfonate in an amount of 0.058 mol, instead of 0.048 mol, was added. Then, an aqueous 0.8M sodium sulfite solution in an amount of 96 mL, instead of 80 mL, was added at a fixed flow rate over 1 minute.

Emulsion 1-D was prepared following the same procedures as for emulsion 1-B except that (addition 5) was changed as follows. The temperature was lowered to 40° C., instead of 55° C. An aqueous solution containing p-iodoacetamidobenzenesulfonate in an amount of 0.058 mol, instead of 0.048 mol, was added. Then, 96 mL of 0.8M sodium sulfite solution was added at a fixed flow rate over 1 minute, and made iodide ions generate, while the pH was controlled at 9.0. Twenty minutes after that, the pH was returened to 5.6.

Emulsion 1-E was prepared following the same procedures as for emulsion 1-B except that (addition 5) was changed as follows. The temperature was lowered to 65° C., instead of 55° C. An aqueous solution containing p-iodoacetamidobenzenesulfonate in an amount of 0.058 mol, instead of 0.048 mol, was added. Then, 96 mL of 0.8M sodium sulfite solution was added at a fixed flow rate over 1 minute. While the pH was controlled to 9.0, iodide ions were produced. Four minutes after that, the pH was lowered to 5.6.

Emulsion 1-F was prepared following the same procedures as for emulsion 1-A except that (addition 5) and (addition 6) were changed as follows. In (addition 5), an aqueous solution containing p-iodoacetamidobenzenesulfonate in an amount of 0.058 mol, instead of 0.048 mol, was added. Then, 96 mL of 0.8M sodium sulfite solution was added at a fixed flow rate over 1 minute, instead of 80 ml of the solution. In (addition 6), aqueous solution X-5 was added over 36 minutes such that the pAg of the bulk emulsion solution in the reaction vessel was held at 8.0, instead of the solution being added over 12 minutes such that the pAg was held at 9.2.

Emulsion 1-G was prepared following the same procedures as for emulsion 1-A except that (addition 5) and (addition 6) were changed as follows. In (addition 5), an aqueous solution containing p-iodoacetamidobenzenesulfonate in an amount of 0.086 mol, instead of 0.048 mol, was added. Then, 144 mL of 0.8M sodium sulfite solution was added at a fixed flow rate over 1 minute, instead of 80 ml of the solution. In (addition 6), aqueous solution X-5 was added over 36 minutes such that the pAg of the bulk emulsion solution in the reaction vessel was held at 8.0, instead of the solution being added over 12 minutes such that the pAg was held at 9.2.

Emulsions 1-H to 1-K

In the preparation of emulsion 1-A, the pAg of (addition 2) was held at 8.4, instead of 8.1. The supply of silver and halide in (addition 3) was changed to a continuous addition of silver halide ultrafine grains (AgBrI with AgI content of 2 mol %, a grain size of about 0.015 $\mu$m) simultaneously prepared in another stirring mixer outside the reaction vessel, while maintaining the pAg at 8.4. Thereby, a base grain emulsion in which the equivalent circle diameter of grains is still larger and the thickness of the grains is thinner was prepared. After that, (addition 5) and the following procedures were carried out as follows to prepare tabular grain emulsions 1-H to 1-K.

Emulsion 1-H was prepared following the same procedures as for emulsion 1-A except that (addition 5) was changed as follows. An aqueous solution containing p-iodoacetamidobenzenesulfonate in an amount of 0.067 mol, instead of 0.048 mol, was added. Then, 112 mL of 0.8M sodium sulfite solution was added at a fixed flow rate over 1 minute, instead of 80 mL of the solution.

Emulsion 1-I was prepared following the same procedures as for emulsion 1-B except that (addition 5) and (addition 6) were changed as follows. In (addition 5), an aqueous solution containing p-iodoacetamidobenzenesulfonate in an amount of 0.067 mol, instead of 0.048 mol, was added. Then, 112 mL of 0.8M sodium sulfite solution was added at a fixed flow rate over 1 minute, instead of 80 ml of the solution. In (addition 6), aqueous solution X-5 was added over 36 minutes such that the pAg of the bulk emulsion solution in the reaction vessel was held at 8.0, instead of the solution being added over 12 minutes such that the pAg was held at 9.2.

Emulsion 1-J was prepared following the same procedures as for emulsion 1-B except that (addition 5) and (addition 6) were changed as follows. In (addition 5), an aqueous solution containing p-iodoacetamidobenzenesulfonate in an amount of 0.096 mol, instead of 0.048 mol, was added. Then, 160 mL of 0.8M sodium sulfite solution was added at a fixed flow rate over 1 minute, instead of 80 ml of the solution. In (addition 6), aqueous solution X-5 was added over 36 minutes such that the pAg of the bulk emulsion solution in the reaction vessel was held at 8.0, instead of the solution being added over 12 minutes such that the pAg was held at 9.2.

Emulsion 1-K was prepared following the same procedures as for emulsion 1-B except that (addition 5) and (addition 6) were changed as follows. In (addition 5), instead of the temperature being lowered to 55° C. immediately after adding 200 mL of aqueous solution G-3, the temperature was lowered to 55° C. after $4\times10^{-4}$ mol/molAg, in relation to the total amount of silver, of the compound set forth below was added. After that, an aqueous solution containing p-iodoacetamidobenzenesulfonate in an amount of 0.086 mol, instead of 0.048 mol, was added. Then, 144 mL of 0.8M sodium sulfite solution was added at a fixed flow rate over 1 minute, instead of 80 ml of the solution. In (addition 6), aqueous solution X-5 was added over 36 minutes such that the pAg of the bulk emulsion solution in the reaction vessel was held at 8.0, instead of the solution being added over 12 minutes such that the pAg was held at 9.2.

$$HO—CH_2CH_2S—CH_2CH_2S—CH_2CH_2OH$$

In the preparation of these emulsions 1-C to 1-K, the addition rates of the aqueous silver nitrate solution and the aqueous halide salt solution were properly controlled to correspond to the critical growth rate of silver halide grains and prevent renucleation or polydispersion by Ostwald ripening.

The grain characteristics of the obtained emulsion 1-A to 1-K are shown in Table 1. (The characteristics of the emulsion grains in examples described later were measured by similar methods.)

TABLE 1

| Emulsion | Av. ECD of tabular grains [Dc (μm)] | Av. Grain thickness of tabular grains [th (μm)] | Ration of tabular grains satisfying Dc ≧ 1.0 μm and th ≦ 0.10 μm to the total projected area (%) | Ratio of grains having 10 or more dislocation lines at fringe portion of grain (%) | Ratio of grains having hexagonal or triangular shape whose side or corner is partly truncated, when observed from a direction perpendicular to (111) main plane (%) |
|---|---|---|---|---|---|
| 1-A | 1.06 | 0.103 | 42 | 48 | 35 |
| 1-B | 1.06 | 0.103 | 42 | 60 | 41 |
| 1-C | 1.14 | 0.090 | 61 | 39 | 53 |
| 1-D | 1.14 | 0.090 | 61 | 59 | 42 |
| 1-E | 1.13 | 0.091 | 61 | 51 | 60 |
| 1-F | 1.14 | 0.090 | 61 | 67 | 58 |
| 1-G | 1.14 | 0.090 | 61 | 90 | 70 |
| 1-H | 1.22 | 0.078 | 80 | 19 | 63 |
| 1-I | 1.22 | 0.078 | 80 | 54 | 61 |
| 1-J | 1.22 | 0.078 | 80 | 87 | 72 |
| 1-K | 1.20 | 0.080 | 80 | 81 | 80 |

ECD = Equivalent circle diameter (Formation and Evaluation of Coated Samples)

A cellulose triacetate film support having an undercoat layer was coated with the aforementioned emulsions 1-A to 1-K under the coating conditions as shown in Table 2 below.

TABLE 2

| Emulsion coating conditions | |
|---|---|
| (1) Emulsion layer | |
| Emulsion . . . Each emulsion | (Silver $1.63\times10^{-2}$ mol/m$^2$) |
| Coupler | ($2.26\times10^{-3}$ mol/m$^2$) |

TABLE 2-continued

| Emulsion coating conditions | |
|---|---|
| 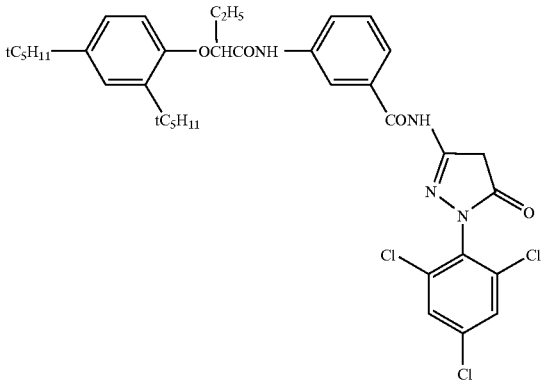 | |
| Tricresyl phosphate | (1.32 g/m$^2$) |
| Gelatin | (3.24 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were subjected to a film hardening process at 40° C. and a relative humidity of 70% for 14 hr. The resultant samples were exposed for 1/100 sec through the SC-50 gelatin filter, a long wave length light-transmitting filter having a cut off wave length of 500 nm, manufactured by Fuji Photo Film Co., Ltd. and a continuous wedge. The density of each sample developed as will be described later was measured through a green filter to evaluate the photographic properties.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabili-Zation | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) common to tank solution and replenisher (g) | |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The results of photographic properties are shown in Table 3 below. The sensitivity was measured under the conditions of the coating liquid of the emulsion being dissolved over time for 1 or 10 hours at 40° C. The sensitivity was represented by the relative value of the reciprocal of an exposure amount necessary to reach the density of a fog density plus 0.2 (the sensitivity of sample 101 is assumed as 100).

Comparison between sample 101 and samples 102 to 111 reveals that the sensitivity/graininess ratio is considerably improved by an emulsion of the present invention wherein a variation coefficient of distribution of equivalent circle diameters of all grains is 40% or less, and the tabular grains, which account for 50% or more of the total projected area, satisfy the following requirements (i) to (iv): (i) silver bromochloroiodide tabular grains having (111) faces as main planes; (ii) the equivalent circle diameter is 1.0 μm or more and a thickness of the grain is 10 μm or less; (iii) ten or more dislocation lines per grain are present at a fringe portion of the grain; and (iv) when the grain is viewed from a direction perpendicular to the (111) main plane, it has a hexagonal or triangular shape whose edge and/or corner are partly substantially hollowed.

TABLE 3

| Sample | Emulsion | Sensitivity using coating solution left to stand for 1 hr | Sensitivity using coating solution left to stand for 10 hr | Remarks |
|---|---|---|---|---|
| 101 | 1-A | 100 | 95 | Comp. |
| 102 | 1-B | 105 | 100 | Comp. |
| 103 | 1-C | 107 | 102 | Comp. |

TABLE 3-continued

| Sample | Emulsion | Sensitivity using coating solution left to stand for 1 hr | Sensitivity using coating solution left to stand for 10 hr | Remarks |
|---|---|---|---|---|
| 104 | 1-D | 120 | 105 | Comp. |
| 105 | 1-E | 117 | 115 | Inv. |
| 106 | 1-F | 123 | 120 | Inv. |
| 107 | 1-G | 132 | 129 | Inv. |
| 108 | 1-H | 110 | 105 | Comp. |
| 109 | 1-I | 126 | 120 | Inv. |
| 110 | 1-J | 141 | 135 | Inv. |
| 111 | 1-K | 141 | 138 | Inv. |

Sensitivity was expressed in relative values assuming the sensitivity of Sample 101 using emulsion whose coating solution was left to stand for 1 hour as 100.

Example 2

Preparation and Evaluation of Emulsions 2-A to 2-L

Emulsions 2-A to 2-L having different variation coefficients of distribution of equivalent circle diameters of all grains were prepared by controlling the grain formation conditions of emulsions 1-B, E and K.

These emulsions included ten or more dislocation lines per grain at a fringe portion of the grain. In these emulsions, the tabular grains having a hexagonal or triangular shape whose edge and/or corner are partly substantially hollowed, when viewed from a direction perpendicular to the (111) main plane, occupied 50% or more of the total projected area of the emulsion grains.

The grain characteristics of the emulsions are shown in Table 4. The coated samples 201 to 212 were formed as in Example 1 using these emulsions and were evaluated. The results are shown in Table 4 below.

TABLE 4

| Sample | Emulsion | Ratio of tabular grains satisfying Dc ≧ 1.0 μm and th ≦ 0.10 μm to the total projected area (%) | COV of ECD of all grains (%) | Sensitivity using coating solution left to stand for 1 hr | Sensitivity using coating solution left to stand for 10 hr | Remarks |
|---|---|---|---|---|---|---|
| 201 | 2-A | 40 | 35 | 100 | 95 | Comp. |
| 202 | 2-B | 40 | 45 | 95 | 89 | Comp. |
| 203 | 2-C | 40 | 20 | 102 | 98 | Comp. |
| 204 | 2-D | 40 | 15 | 105 | 100 | Comp. |
| 205 | 2-E | 60 | 35 | 117 | 115 | Inv. |
| 206 | 2-F | 60 | 45 | 112 | 102 | Comp. |
| 207 | 2-G | 60 | 20 | 123 | 120 | Inv. |
| 208 | 2-H | 60 | 15 | 126 | 123 | Inv. |
| 209 | 2-I | 80 | 35 | 138 | 135 | Inv. |
| 210 | 2-J | 80 | 45 | 126 | 110 | Comp. |
| 211 | 2-K | 80 | 20 | 141 | 138 | Inv. |
| 212 | 2-L | 80 | 15 | 145 | 141 | Inv. |

Sensitivity was expressed in relative values assuming the sensitivity of Sample 201 using emulsion whose coating solution was left to stand for 1 hour as 100. ECD = Equivalent circle diameter COV = Coefficient of variation of distribution As apparent from Table 4, in the emulsion of the present invention, the less the variation coefficient of distribution of equivalent circle diameters of all grains is, the higher the sensitivity is, and the better the stability of a dissolved coating liquid over time is.

Example 3

Emulsions A to N were Prepared by the Following Preparation Methods (Preparation of Em-A)

42.2L of an aqueous solution containing 31.7 g of a low-molecular-weight gelatin of 15,000 molecular weight converted to phthalate at a ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of gelatin-4 set forth in Example 1 were added by the double jet method over a period of 1 min. Immediately after the completion of the addition, 52.8 g of KBr was added, 2485 mL of an aqueous solution containing 398.2 g of $AgNO_3$ and 2581 mL of an aqueous solution containing 291.1 g of KBr were added by the double jet method over a period of 2 min. Immediately after the completion of the addition, 44.8 of KBr was added and heated to 40° C., and the mixture was ripened. After the completion of the ripening, 923 g of gelatin-2 and 79.2 g of KBr were added, and an aqueous solution of KBr and 15,947 mL of an aqueous solution containing 5103 g of $AgNO_3$ were added by the double jet method over a period of 10 min while increasing the flow rate so that the final flow rate was 1.4 times the initial flow rate. During this period, the pAg of the bulk emulsion solution in the reaction vessel was maintained at 9.90.

The mixture was washed with water, and gelatin-1 of Example 1 was added, effecting adjustments to a pH of 5.7, a pAg of 8.8, and a gelatin weight to 64.1 g and weight of the emulsion, in terms of silver, to 131.8 g per kg of emulsion. Thus, a seed emulsion was obtained. 1211 mL of an aqueous solution containing 46 g of a gelatin-2 of Example 1 and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the pAg of the bulk emulsion solution in the reaction vessel was maintained at 8.15. 2 mg of sodium benzenethiosulfonate and 2 mg of thiourea dioxide were added, and 328 mL of an aqueous solution containing 105.6 g of $AgNO_3$ and an aqueous solution of KBr were added by the double jet method over a period of 56 min while increasing the flow rate so that the final flow rate was 3.7 times the initial flow rate. During this period, a AgI fine grain emulsion of 0.037 $\mu$m grain size was simultaneously added while conducting a flow rate increase so that the silver iodide content was 27 mol %, and the pAg of the bulk emulsion sultion was maintained at 7.60. The mixture was heated to 82° C., and KBr was added to thereby adjust the pAg of the bulk emulsion solution at 8.80. Thereafter, the above AgI fine grain emulsion was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the pAg of the bulk emulsion solution was maintained at 8.80.

The mixture was washed with water, and gelatin-1 of Example 1 was added, adjusting the pH and pAg thereof at 40° C. to 5.8 and 8.7, respectively. After TAZ-1 was added, and the mixture was heated to 60° C. Sensitizing dye Ex-4 was added in the form of a solid fine dispersion, and then, potassium thiocyanate, chloroauric acid, sodium thiosulfate and N,N-dimethylselenourea were added to thereby effect optimum chemical sensitization. At the completion of chemical sensitization. At the completion of chemical sensitization compounds MER-1 and MER-3 were added. The terminology "optimum chemical sensitization" used herein means that the addition amount of sensitizing dye or each compound has been selected so as to fall within the range of $10^{-1}$ to $10^{-8}$ mol per mol of silver halide.

Sensitizing Dye for Blue-sensitive Emulsion Exs-4

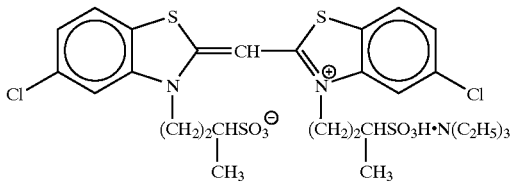

MER-3

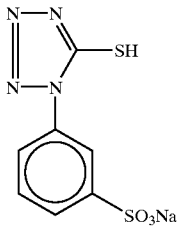

TAZ-1

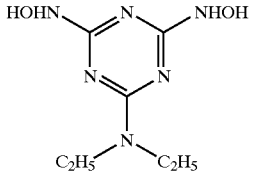

(Preparation Method of Em-B)

1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double-jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double-jet method while the flow rates were accelerated such that the final flow rates were 3 times the initial flow rates. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double-jet method while the flow rates were accelerated such that the final flow rates were 5.1 times the initial flow rates. During the addition, the AgI fine-grain emulsion used in the preparation of Em-D was simultaneously added at an accelerated flow rate so that the silver iodide content was 15.8 mol %. Also, the pAg of the bulk emulsion solution in the reaction vessel was held at 7.85.

96.5 mL of an aqueous solution containing 24.1 g of $AgNO_3$ and an aqueous KBr solution were added over 3 min by the double-jet method. During the addition, the pAg of the bulk emulsion solution in the reaction vessel was held at 7.85. After 26 mg of sodium ethylthiosulfonate were added, the temperature was lowered to 55° C., and an aqueous KBr solution was added to adjust the pAg of the bulk emulsion solution in the reaction vessel to 9.80. The aforementioned AgI fine-grain emulsion was added in an amount of 8.5 g as a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel at the end of the addition to 8.75. The resultant emulsion was washed with water and chemically sensitized with ExS-4.

(Preparation Method of Em-C)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double-jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double-jet method while the flow rates were accelerated such that the final flow rates were 3.8 times the initial flow rates. During the addition, the pAg of the bulk emulsion solution in the reaction vessel was held at 8.65.

440.6 mL of an aqueous solution containing 110.2 g of $AgNO_3$ and an aqueous KBr solution were added over 24 min by the double-jet method while the flow rates were accelerated such that the final flow rates were 5.1 times the initial flow rates. During the addition, the AgI fine-grain emulsion used in the preparation of Em-A was simultaneously added at an accelerated flow rate so that the silver iodide content was 2.3 mol %. Also, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double-jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine-grain emulsion was added in an amount of 6.4 g as a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel at the end of the addition to 8.65. The resultant emulsion was washed with water and chemically sensitized with Exs-4.

(Preparation Method of Em-D)

In the preparation of Em-C, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel at the end of the addition was adjusted to 6.85 by using an aqueous KBr solution. Em-D was prepared following substantially the same procedures as for Em-C except the foregoing.

(Preparation Method of Em-E)

1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double-jet method. After the ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double-jet method. During the addition, the pAg of the bulk emulsion solution in the reaction vessel was held at 9.05. An aqueous solution containing 65.6 g of $AgNO_3$ and an aqueous KBr solution were added over 46 min by the double-jet method while the flow rate was accelerated so that the final flow rate was 2.1 times the initial flow rate. During the addition, the abovementioned AgI fine-grain emulsion was simultaneously added at an accelerated flow rate such that the silver iodide content was 6.5 mol %. Also, the pAg of the bulk emulsion solution in the reaction vessel was held at 9.05.

After 1.5 mg of thiourea dioxide was added, 132 mL of an aqueous solution containing 41.8 g of $AgNO_3$ and an aqueous KBr solution were added over 16 min by the double-jet method. The addition of the aqueous KBr solution was so adjusted that the pAg of the bulk emulsion solution in the reaction vessel at the end of the addition was at 7.70. After 2 mg of sodium benzenethiosulfonate were added, the pAg of the bulk emulsion solution in the reaction vessel was adjusted to 9.80 by adding KBr. After that, the aforementioned AgI fine-grain emulsion was added in an amount of 6.2 g as a KI weight. Immediately after the addition, 300 mL of an aqueous solution containing 88.5 g of $AgNO_3$ were added over 10 min. The pAg of the bulk emulsion solution in the reaction vessel at the completion of the addition was adjusted to 7.40 by the addition of a KBr solution. After washing with water, gelatin-1 of Example 1 was added, and the pH and the pAg were adjusted to 6.5 and 8.2, respectively, at 40° C. TAZ-1 was added, and the temperature was raised to 58° C. After sensitizing dyes Exs-1 to -3 were added, the emulsion was optimally, chemically sensitized by adding potassium thiocyanate, chloroauric acid, sodium thiosulfate, and N,N-dimethylselenourea. At the end of the chemical sensitization, MER-1 and MER-3 were added.

(Preparation Method of Em-F)

1,200 mL of an aqueous solution containing 0.70 g of gelatin-4 of Example 1, 0.9 g of KBr, 0.175 g of KI, and 0.2 g of the modified silicone oil used in the preparation of Em-A were held at 33° C. and stirred with violence at pH 1.8. An aqueous solution containing 1.8 g of $AgNO_3$ and an aqueous KBr solution containing 3.2 mol % of KI were added over 9 sec by the double-jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double-jet method. During the addition, an AgI fine-grain emulsion having a grain size of 0.008 $\mu$m and 270 mL of aqueous solution containing 27.58 g of $AgNO_3$ were simultaneously added such that the silver iodide content was 4.1 mol %. This AgI fine-grain emulsion was prepared, immediately before the addition, by mixing an aqueous solution of gelatin-4 of Example 1, an aqueous $AgNO_3$ solution, and an aqueous KI solution in another chamber having a magnetic coupling induction type stirrer described in JP-A-10–43570. Also, the pAg of the bulk emulsion solution in the reaction vessel was held at 9.15.

After 2.6 g of KBr were added, an aqueous solution containing 87.7 g of $AgNO_3$ and an aqueous KBr solution were added over 49 min by the double-jet method while the flow rates were accelerated so that the final flow rates were 3.1 times the initial flow rates. During the addition, the aforementioned AgI fine-grain emulsion prepared by mixing immediately before addition was simultaneously added at an accelerated flow rate such that the silver iodide content was 7.9 mol %. Also, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double-jet method. The addition of the aqueous KBr solution was so adjusted that the pAg of the bulk emulsion solution in the reaction vessel at the end of the addition was 7.90. After the temperature was raised to 78° C. and the pH was adjusted to 9.1, KBr was added to adjust the pAg of the bulk emulsion solution in the reaction vessel to 8.70. The AgI fine-grain emulsion used in the preparation of Em-A was added in an amount of 5.73 g as a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70 by an aqueous KBr solution. The resultant emulsion was washed with water and chemically sensitized using Exs-1 to -3 as the chemical sensitizers.

(Preparation Method of Em-H)

Em-H was prepared in almost the same manner as for Em-G, except that the temperature during grain formation was changed to 35° C.

(Preparation Method of Emulsion Em-I)

1,200 mL of an aqueous solution containing 0.75 g of gelatin-4 in Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double-jet method. During the addition, the excess KBr concentration was maintained constant. The temperature of raised to 54° C., to ripen the emulsion. After ripening, 20 g of gelatin-2 of Example 1 were added. After the pH was adjusted to 5.9, 2.9 g of KBr were added. After adding 3 mg of thiourea dioxide 288 mL of an aqueous solution containing 28.8 g of $AgNO_3$ and an aqueous KBr solution were added over 58 min by the double-jet method. During the addition, the AgI fine grain emulsion having a grain size of 0.03 μm was simultaneously added such that the silver iodide content became 4.1 mol %, and the pAg of the bulk solution in the section vessel was held at 9.40. After adding 2.5 g of KBr, an aqueous solution containing 87.7 g of $AgNO_3$ and an aqueous KBr solution were added over 69 min by the double-jet method while the flow rates were accelerated so that the final flow rates were 1.2 times the initial flow rates. During the addition, the AgI fine-grain emulsion mentioned above was simultaneously added at an accelerated flow rate such that the silver iodide content was 10.5 mol %. Also, the pAg of the bulk emulsion solution in the reaction vessel was held at 9.50.

132 mL of an aqueous solution containing 41.8 g of $AgNO_3$ and an aqueous KBr solution were added over 27 min by the double-jet method. The addition of the aqueous KBr solution was so adjusted that the pAg of the bulk emulsion solution in the reaction vessel at the end of the addition was 8.15. After 2 mg of sodium benzenethiosulfonate were added, KBr was added to adjust the pAg of the bulk emulsion solution in the reaction vessel to 9.50. The abovementioned AgI fine-grain emulsion was added in an amount of 5.73 g as a KI weight. Immediately after the addition, 609 mL of an aqueous solution containing 66.4 g of $AgNO_3$ were added over 11 min. An aqueous KBr solution was added to adjust pAg of the bulk emulsion solution in the reaction vessel at the initial 6 min of the addition to 9.50 mV. After washing with water, gelatin was added, and the pH and the pAg were adjusted to 6.5 and 8.2, respectively at 40° C. Then TAZ-1 was added, the temperature was raised to 56° C. Sensitizing dyes Exs-5 and -6 (in a mixed ratio of 69:31) were added. After that, the emulsion was optimally, chemically sensitized by adding potassium thiocyanate, chloroauric acid, sodium thiosulfate, and N,N-dimethylselenourea. At the end of the chemical sensitization, MER-1 and MER-3 were added.

Exs-5

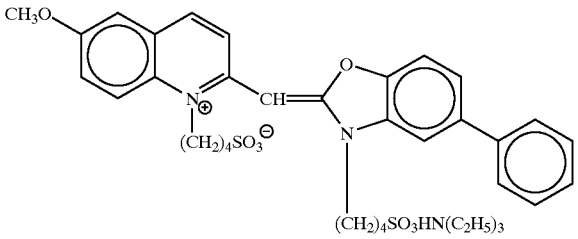

Exs-6

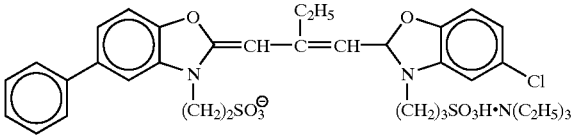

(Preparation Method of Em-J)

1,200 mL of an aqueous solution containing 0.38 g of gelatin-2 of Example 1 and 0.9 g of KBr were vigorously stirred at 60° C. An aqueous solution containing 1.03 g of $AgNO_3$ and an aqueous solution containing 0.88 g of KBr and 0.09 g of KI were added over 30 sec by the double-jet method. After the ripening, 1.28 g of gelatin-3 of Example 1 was added. The pH was adjusted to 5.9, then, 2.99 g of KBr and 6.2 g of NaCl were added. 60.7 mL of an aqueous solution containing 27.3 g of $AgNO_3$ and a KBr solution were added by the double-jet method over 39 min. During the addition, the pAg of the bulk emulsion solution in the reaction vessel was maintained at 9.05. A solution containing 65.6 g of $AgNO_3$ and a KBr solution were added by the double-jet method over 46 min such that the final flow rates were 2.1 times the initial flow rates. During the addition, AgI fine grain emulsion used in the preparation of Em-A was simultaneously added in an accelerated flow rate such that the silver iodide content became 6.5 mol %. The pAg of the bulk emulsion solution in a reaction vessel was maintained at 9.05.

After 1.5 mg of thiourea dioxide were added, 132 mL of an aqueous solution containing 41.8 g of $AgNO_3$ and an aqueous KBr solution were added over 16 min by the double-jet method. The addition of the aqueous KBr solution was so adjusted that the pAg of the bulk emulsion solution in the reaction vessel was 7.70. After 2 mg of sodium benzenethiosulfonate were added, KBr was added to adjust the pAg of the bulk emulsion solution in the reaction vessel to 9.80. The abovementioned AgI fine-grain emulsion was added in an amount of 6.2 g as a KI weight. Immediately after the addition, 300 mL of an aqueous solution containing 88.5 g of $AgNO_3$ were added over 10 min. An aqueous KBr solution was added to adjust the pAg of the bulk emulsion solution in the reaction vessel to 7.40. After washing with water, gelatin-1 of Example 1 was added, and the pH and the pAg were adjusted to 6.5 and 8.2, respectively at 40° C. After TAZ-1 was added, the temperature was raised to 58° C. Sensitizing dyes Exs-7, -8 and -9 were added, then, the emulsion was optimally, chemically sensitized by adding $K_2IrCl6$, potassium thiocyanate, chloroauric acid, sodium thiosulfate, and N,N-dimethylselenourea. At the end of the chemical sensitization, MER-1 and MER-3 were added.

Sensitivity Dye for Red-sensitive Emulsion Exs-7

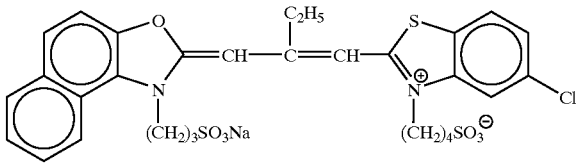

Sensitivity Dye for Red-sensitive Emulsion Exs-8

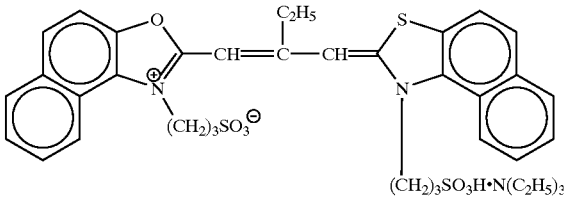

Sensitivity Dye for Red-sensitive Emulsion Exs-9

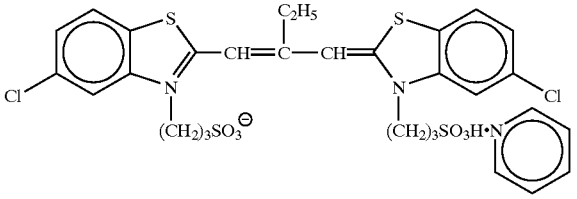

Sensivity Dyes Ussed in Red-sensitive Emulsions are a Mixture of Exs-7:Exs-8:Exs-9=40:2:58 in a Molar Ratio (Preparation Method of Em-L)

Em-L was prepared following substantially the same procedures as for Em-K except that the nucleation temperature was changed to 40° C.

(Preparation Method of Em-M)

Em-M was prepared following substantially the same procedures as for Em-J except that chemical sensitization was performed in substantially the same manner as for Em-F.

TABLE 5

| Emulsion | ECD (μm) COV (%) | Th (μm) COV (%) | Aspect ratio COV (%) | Tblrty | Twin plane distance (μm) COV (%) | Ratio of tabular grains having (111) main planes to the total projected area (%) | (100) face ratio in side faces (%) | AgI content (mol %) COV (%) | AgCl Content (mol %) | Surface AgI content (mol %) |
|---|---|---|---|---|---|---|---|---|---|---|
| A | 1.98 | 0.198 | 10 | 51 | 0.014 | 92 | 23 | 15 | 0 | 4.3 |
| | 23 | 28 | 35 | | 32 | | | 17 | | |
| B | 1.30 | 0.108 | 12 | 111 | 0.013 | 93 | 22 | 11 | 0 | 3.6 |
| | 25 | 27 | 38 | | 30 | | | 16 | | |
| C | 1.00 | 0.083 | 12 | 145 | 0.012 | 93 | 18 | 4 | 1 | 1.8 |
| | 27 | 26 | 37 | | 30 | | | 8 | | |
| D | 0.75 | 0.075 | 10 | 133 | 0.010 | 91 | 33 | 4 | 2 | 1.9 |
| | 31 | 18 | 29 | | 27 | | | 8 | | |
| E | 2.38 | 0.138 | 17 | 125 | 0.013 | 98 | 23 | 5 | 1 | 1.6 |
| | 20 | 20 | 23 | | 19 | | | 6 | | |
| F | 1.08 | 0.072 | 15 | 208 | 0.008 | 97 | 23 | 6 | 0 | 2.0 |
| | 18 | 15 | 19 | | 22 | | | 5 | | |
| G | 0.44 | 0.220 | 2 | 9 | 0.013 | 90 | 38 | 3 | 2 | 1.0 |
| | 16 | 13 | 9 | | 18 | | | 6 | | |
| H | 0.33 | 0.165 | 2 | 12 | 0.013 | 88 | 42 | 3 | 2 | 1.0 |
| | 17 | 13 | 12 | | 18 | | | 6 | | |
| I | 2.25 | 0.107 | 21 | 197 | 0.013 | 99 | 20 | 7.2 | 0 | 2.4 |
| | 31 | 19 | 34 | | 33 | | | 7 | | |
| J | 2.38 | 0.138 | 17 | 125 | 0.013 | 98 | 23 | 5 | 1 | 1.6 |
| | 20 | 20 | 23 | | 19 | | | 6 | | |
| K | 1.83 | 0.122 | 15 | 123 | 0.012 | 98 | 23 | 5 | 1 | 1.8 |
| | 18 | 20 | 22 | | 19 | | | 6 | | |
| L | 0.84 | 0.120 | 7 | 58 | 0.013 | 99 | 25 | 3 | 0 | 2.7 |
| | 17 | 18 | 19 | | 16 | | | 7 | | |
| M | 0.44 | 0.220 | 2 | 9 | 0.013 | 88 | 42 | 2 | 2 | 1.0 |
| | 17 | 13 | 12 | | 18 | | | 6 | | |
| N | 0.33 | 0.165 | 2 | 12 | 0.013 | 88 | 46 | 1 | 2 | 0.5 |
| | 17 | 13 | 12 | | 18 | | | 6 | | |
| O | 0.07 | 0.070 | 1 | — | — | — | — | 1 | 0 | — |
| | — | — | — | | — | | | — | | |
| P | 0.07 | 0.070 | 1 | — | — | | | | | |
| | — | — | — | | | | | | | |

ECD = Equivalent circle diameter
COV = Coefficient of variation
Th = Thickness
Tblrty = Tabularity 1) Support A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω.cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH—C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4). Coating of Sensitive Layers (Sample 301)

The surface on the side away from the back layers formed as above was coated with a plurality of layers having the following compositions, thereby preparing sample 301 which is a color negative sensitive material.

(Compositions of Sensitive Layers)

The main ingredients used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |

(In the following description, practical compounds have numbers attached to their symbols. Formulas of these compounds will be presented later.)

The number corresponding to each component indicates the coating amount in units of g/m$^2$. The coating amount of silver halide is indicated interms of silver.

| | | |
|---|---|---|
| 1st layer (1st antihalation layer) | | |
| Black colloidal silver | silver | 0.155 |
| Silver bromoiodide emulsion P | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.066 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| Silver bromoiodide emulsion O | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver bromochloroiodide emulsion N | silver | 0.065 |
| Silver bromochloroiodide emulsion M | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver bromoiodide emulsion L | silver | 0.21 |
| Silver bromoiodide emulsion K | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver bromochloroiodide emulsion J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |

-continued

| | | |
|---|---|---|
| 8th layer (layer for donating interlayer effect to red-sensitive layer) | | |
| Silver bromoiodide emulsion I | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver bromoiodide emulsion H | silver | 0.39 |
| Silver bromochloroiodide emulsion G | silver | 0.28 |
| Silver bromochloroiodide emulsion F | silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver bromoiodide emulsion 1-A of Example 1 | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver bromochloroiodide emulsion E | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Solid disperse dye ExF-6 | | 0.015 |
| Oil-soluble dye ExF-5 | | 0.010 |
| HBS-1 | | 0.082 |
| Gelatin | | 1.057 |
| 13th layer (Low-speed blue-sensitive emulsion layer) | | |
| Silver bromochloroiodide emulsion D | silver | 0.18 |
| Silver bromoiodide emulsion B | silver | 0.20 |
| Silver bromochloroiodide emulsion C | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver bromoiodide emulsion A | silver | 0.75 |
| ExC-1 | | 0.013 |

-continued

| | | |
|---|---|---|
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| Silver bromoiodide emulsion O | silver | 0.30 |
| UV-1 | | 0.21 |
| UV-2 | | 0.13 |
| UV-3 | | 0.20 |
| UV-4 | | 0.025 |
| F-11 | | 0.009 |
| F-18 | | 0.005 |
| F-19 | | 0.005 |
| HBS-1 | | 0.12 |
| HBS-4 | | $5.0 \times 10^{-2}$ |
| Gelatin | | 2.3 |
| 16th layer (2nd protective layer) | | |
| H-1 | | 0.40 |
| B-1 (diameter 1.7 $\mu$m) | | $5.0 \times 10^{-2}$ |
| B-2 (diameter 1.7 $\mu$m) | | 0.15 |
| B-3 | | 0.05 |
| S-1 | | 0.20 |
| Gelatin | | 0.75 |

In addition to the above components, to improve the storagebility, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 $\mu$m.

Following the same procedure as above, solid dispersions ExF-4 was obtained. The average grain sizes of the fine dye grains was 0.45. EXF-2 was dispersed by a microprecipitation dispersion method described in Example 1 of EP549, 489A. The average grain size was found to be 0.06 $\mu$m.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min. The average grain size was 0.52 $\mu$m.

(Preparation of Solid Fine Dispersions)

The sensitizing dyes of the present invention was used in a solid fine dispersed form prepared by the method described in JP-A-11-52507.

For example, solid fine dispersion of sensitizing dye ExC-1 was prepared as follows.

0.8 parts By weight of $NaNO_3$ and 3.2 parts by weight of $Na_2SO_3$ were dissolved in 43 parts by weight of ion-exchanged water, and 13 parts by weight of the sensitizing dye was added. Solid dispersion of sensitizing dye ExC-1 was obtained by dispersing the mixture using dissolver blades at 2000 rpm for 20 min at the condition of 60° C.

The compounds used in the above layers are those as set forth below.

ExC-1

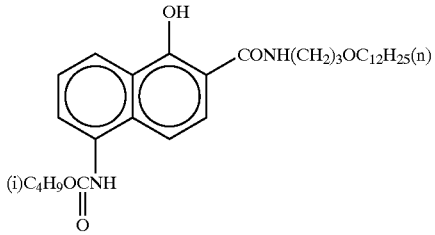

ExC-2

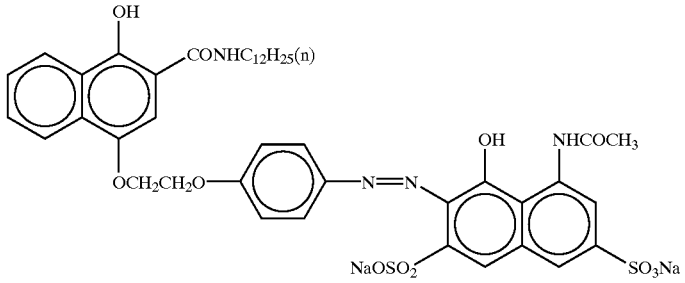

ExC-3

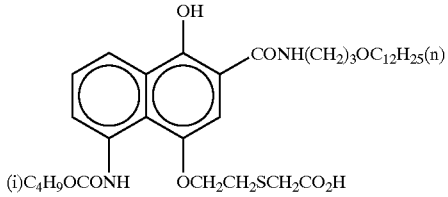

ExC-4

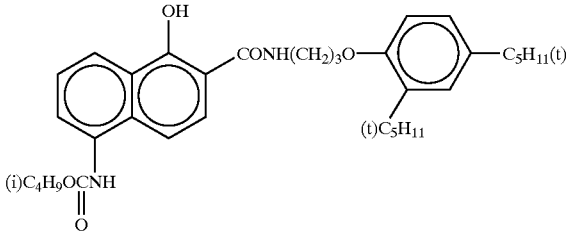

ExC-5

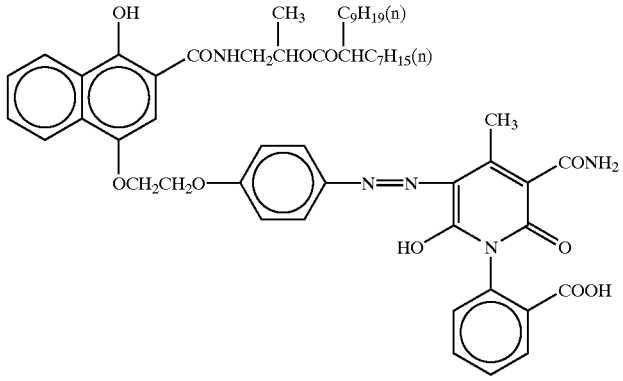

-continued
ExC-6
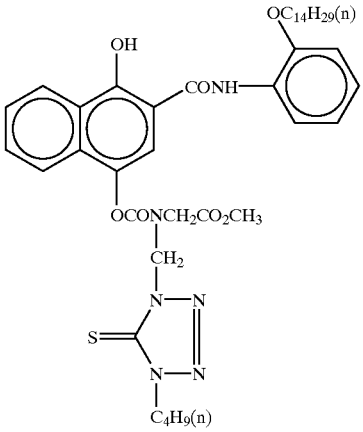
ExC-7
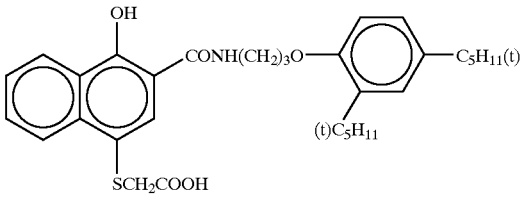
ExC-8
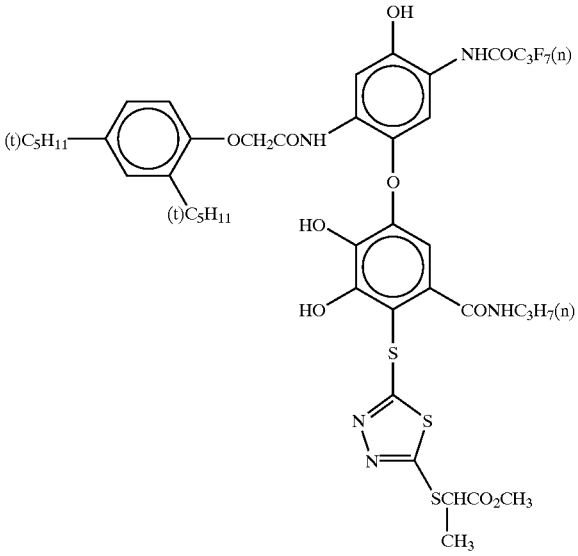
ExM-1
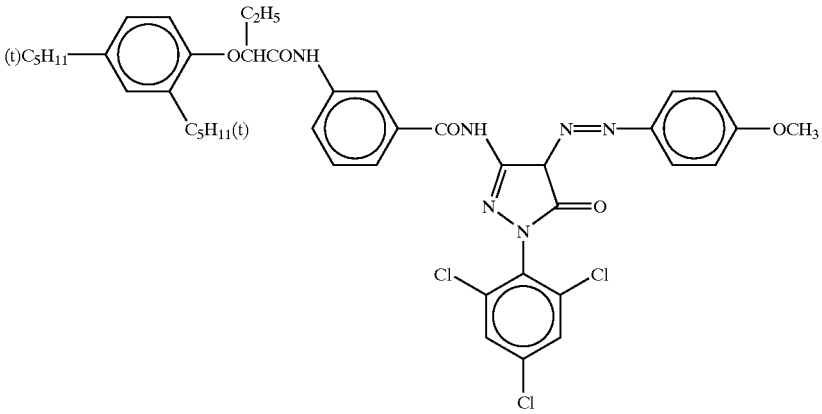

-continued
ExM-2
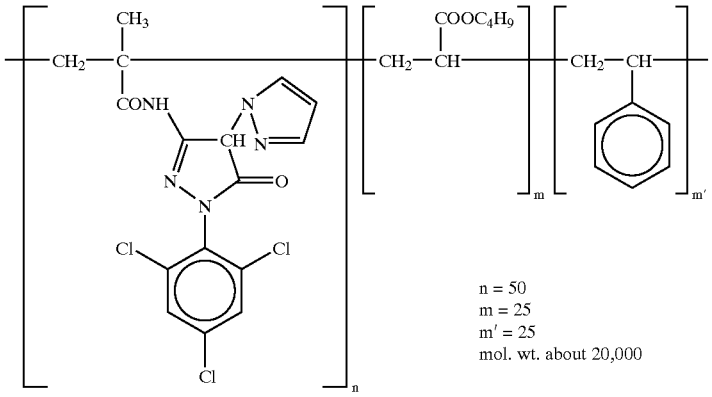
ExM-3
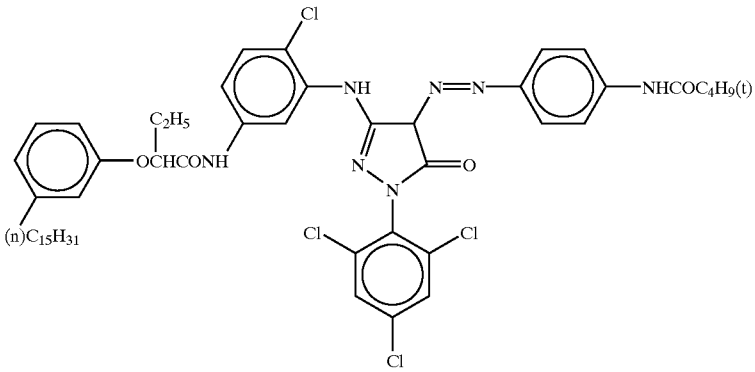
ExM-4
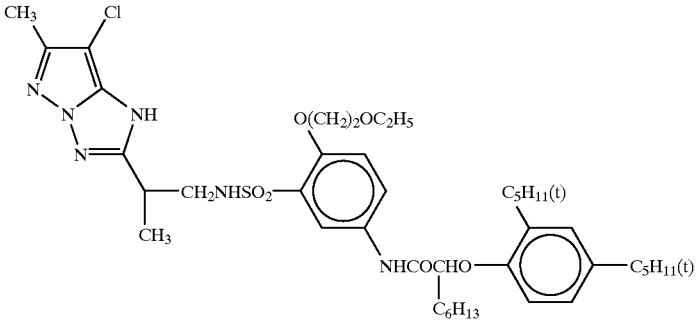
ExM-5
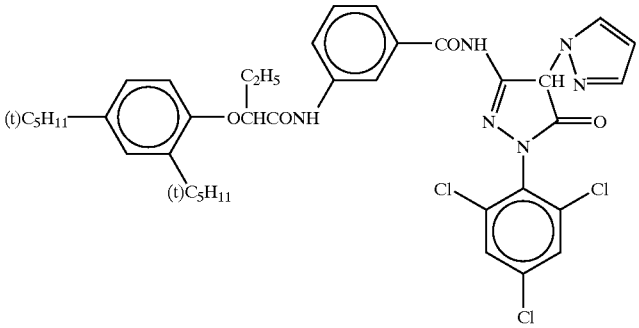

-continued
ExY-1
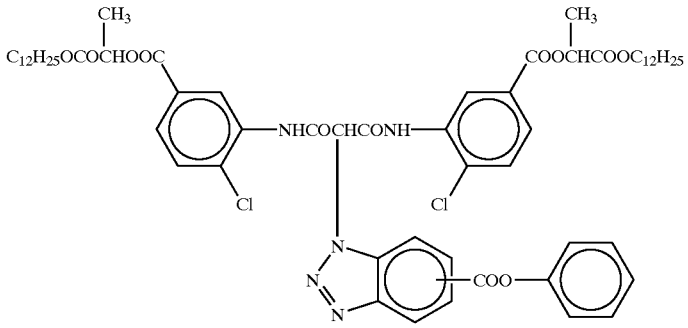
ExY-2
ExY-3
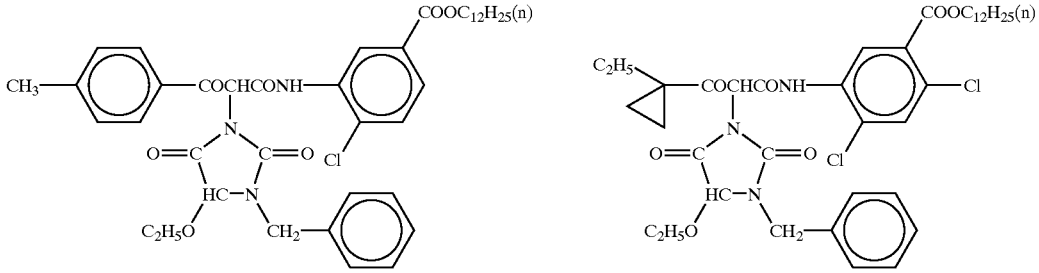
ExY-4
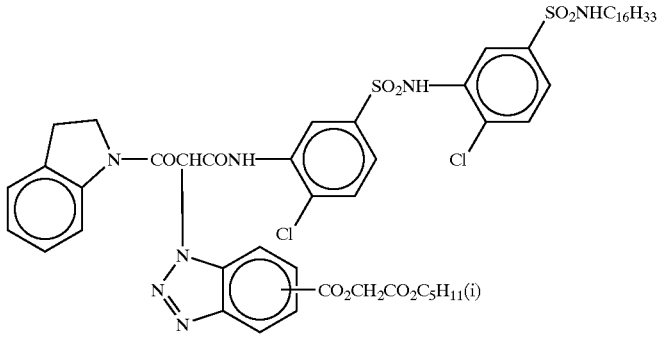
ExY-5
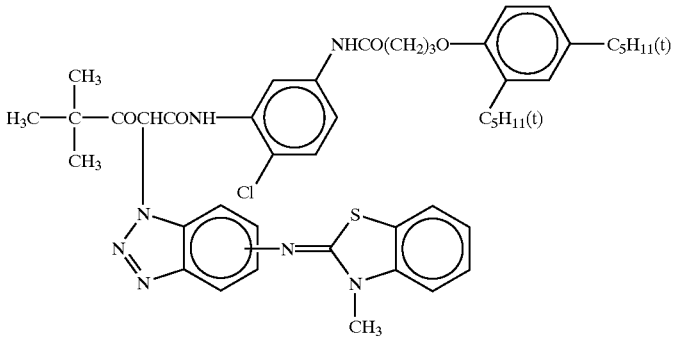
ExY-6
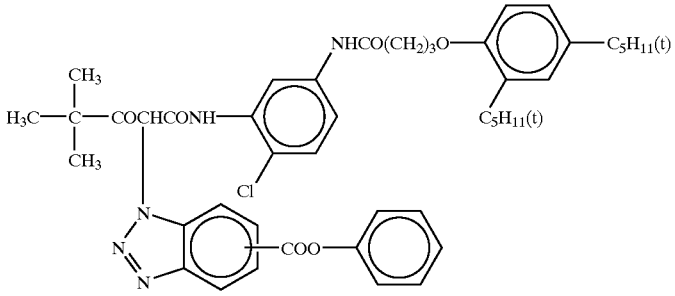

-continued
ExG-1
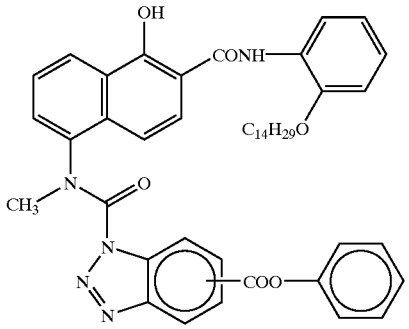
ExF-1
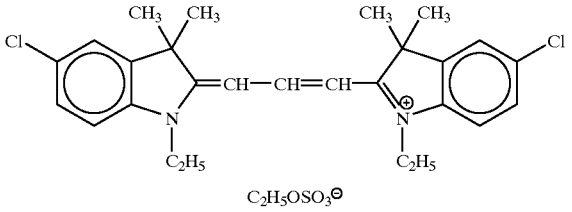
ExF-2
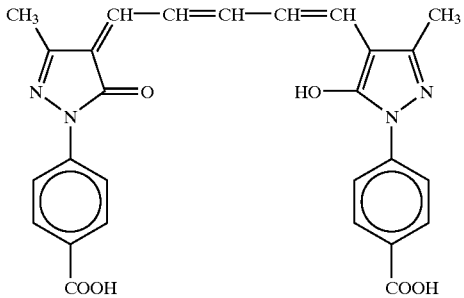
ExF-3
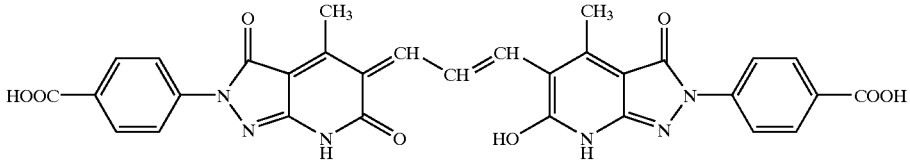
ExF-4
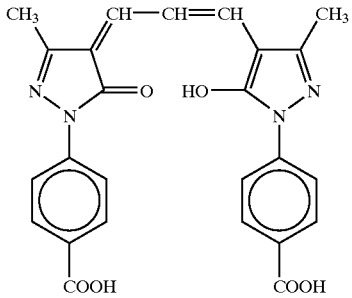
ExF-5
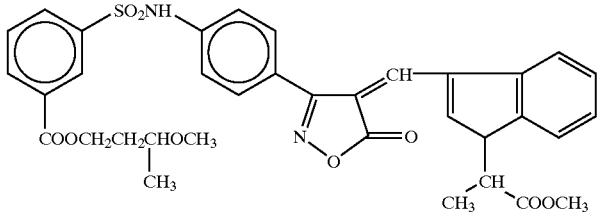

-continued
ExF-6
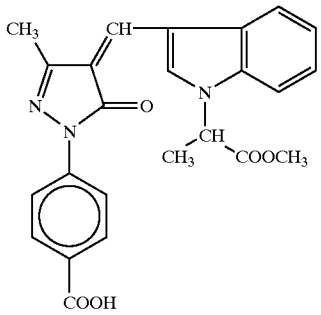
Cpd-1
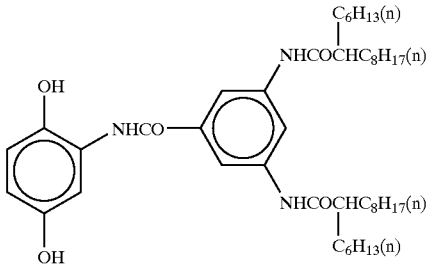
Cpd-2
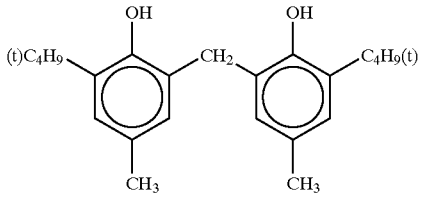
Cpd-3
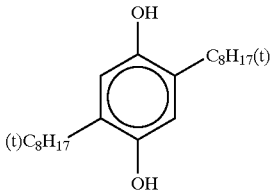
Cpd-4
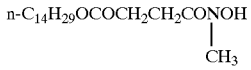
UV-1
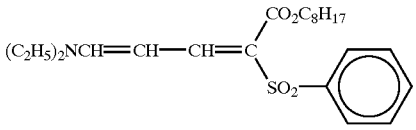
UV-2
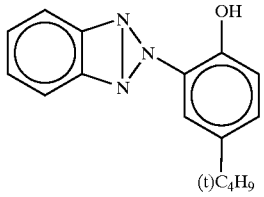
UV-3
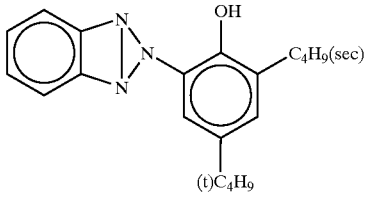
UV-4
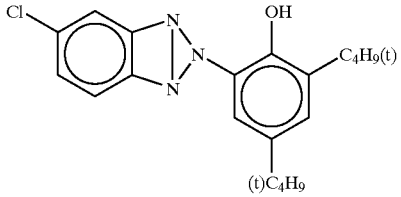
HBS-1
Tricresyl phosphate
Di-n-butyl phthalate
HBS-2
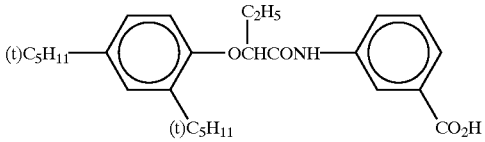
HBS-3
Tri(2-ethylhexyl) phosphate
HBS-4
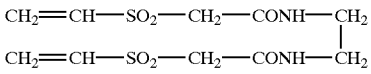
H-1
S-1
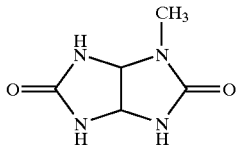
B-1
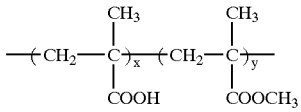
x/y = 10/90 (Wt. ratio)
Av. Mol. Wt.: about 35,000

-continued
B-2
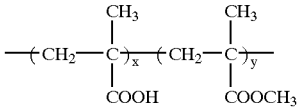
x/y = 40/60 (Wt. ratio)
Av. Mol. Wt.: about 20,000
B-3
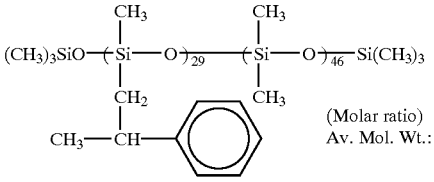
(Molar ratio)
Av. Mol. Wt.: about 8,000
B-4
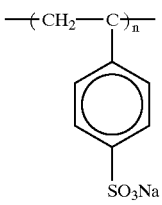
Av. Mol. Wt.: about 750,000
B-5
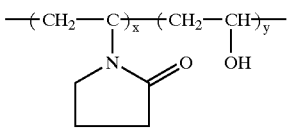
x/y = 70/30 (Wt. ratio)
Av. Mol. Wt.: about 17,000
B-6
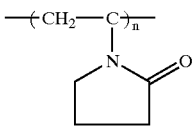
Av. Mol. Wt.: about 10,000
W-1
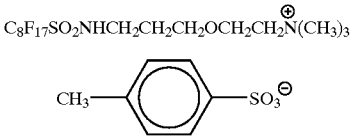
W-2
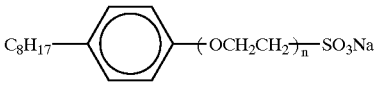
n = 2–4
W-3
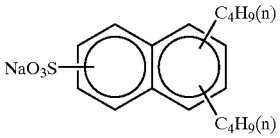
W-4
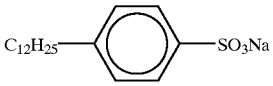
W-5
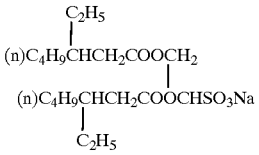
F-1
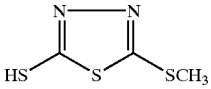
F-2
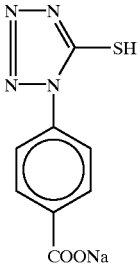
F-3
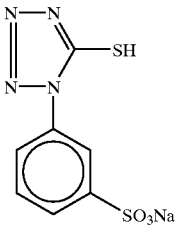
F-4
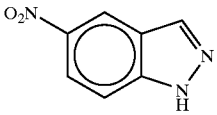
F-5
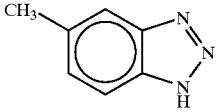
F-6
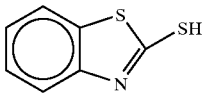

-continued

F-7

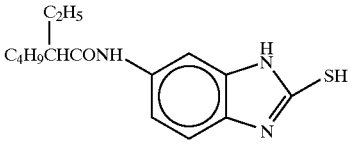

F-8

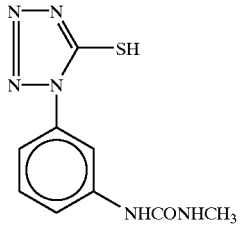

F-9

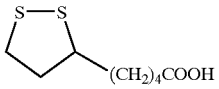

F-10

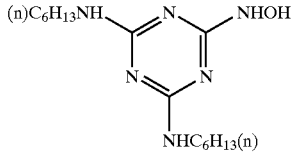

F-11

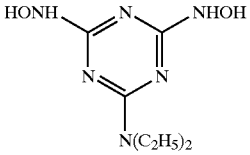

F-12

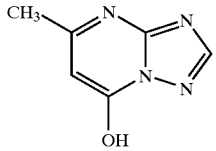

F-13

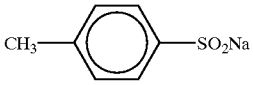

F-14

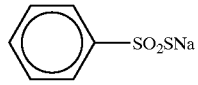

F-15

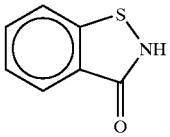

F-16

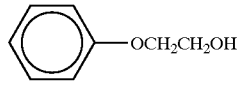

F-17

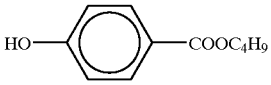

F-18

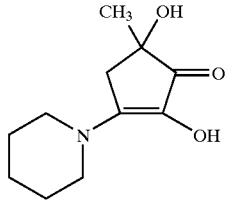

F-19

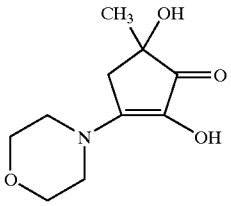

(Preparation of Samples 302 to 305)

Samples 302 to 305 were prepared by using Emulsion 1-D, 1-G, 1-H, and 1-K, in place of Emulsion 1-A of the 10th layer.

These samples were subjected to film hardening for 14 hr at 40 °C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |

-continued (Processing steps)

| Step | Time | Temperature | Replenishment rate* | Tank volume |
|---|---|---|---|---|
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each cross-over time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

-continued

| | <Tank solution> (g) | <Replenisher> (g) |
|---|---|---|
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |
| (Washing water) | | |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The photographic performance of the processed samples was evaluated by measuring the density with a green filter. The sensitivity was measured under the conditions of the coating liquid of the 10th layer being dissolved over time for 1 or 10 hours at 40° C. The sensitivity was evaluated by the relative value of the reciprocal of an exposure amount necessary to reach the magenta density of a fog density plus 0.8. The results are set forth in Table 6. The advantages of the invention were demonstrated with color negative multi-layered samples, as in the results shown in Example 1.

TABLE 6

| Sample | Emulsion | Sensitivity using emulsion left to stand for 1 hr | Sensitivity using emulsion left to stand for 10 hr | Remarks |
|---|---|---|---|---|
| 301 | 1-A | 100 | 95 | Comp. |
| 302 | 1-D | 117 | 105 | Comp. |
| 303 | 1-G | 126 | 123 | Inv. |
| 304 | 1-H | 107 | 105 | Comp. |
| 305 | 1-K | 135 | 132 | Inv. |

Sensitivity was expressed in relative values assuming the sensitivity of Sample 301 using emulsion whose coating solution was left to stand for 1 hour as 100.

The other emulsions prepared in Examples 1–3 were evaluated in a similar manner to the above. As a result, the relative relationships thereof in the color negative multilayered samples were the same.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined in the appended claims and their equivalents.

What is claimed is:

1. A silver halide photographic emulsion containing silver halide grains wherein a variation coefficient of distribution of equivalent circle diameters of all the silver halide grains is 40 to 3%, and tabular grains, which satisfy the following requirements (i) to (iv), account for 50% or more of the total projected area of the silver halide grains:

(i) silver bromoiodide or silver bromochloroiodide tabular grains having (111) faces as main planes, (ii) the equivalent circle diameter is 1.0 $\mu$m or more and a thickness is 0.10 $\mu$m or less, (iii) ten or more dislocation lines per grain are present at a fringe portion of the grain, and (iv) when the grain is viewed from a direction perpendicular to the (111) main plane, it has a hexagonal or triangular shape whose edge and/or corner are partly substantially hollowed.

2. The silver halide photographic emulsion according to claim 1, wherein the tabular grains, which satisfy the above requirements (i) to (iv), account for 80% or more of the total projected area.

3. The silver halide photographic emulsion according to claim 2, wherein the variation coefficient of the equivalent circle diameters is 25 to 3%.

4. The silver halide photographic emulsion according to claim 3, wherein the variation coefficient of the equivalent circle diameters is 15 to 3%.

5. The silver halide photographic emulsion according to claim 1, wherein the variation coefficient of the equivalent circle diameters is 25 to 3%.

6. The silver halide photographic emulsion according to claim 5, wherein the variation coefficient of the equivalent circle diameters is 15 to 3%.

7. The silver halide photographic emulsion of claim 1, wherein the tabular grains, which satisfy the above requirements (i) to (iv), account for 90 to 100% of the total projected area.

8. The silver halide photographic emulsion of claim 1, wherein the tabular grains, which satisfy the above requirements (i) to (iv), account for 95 to 100% of the total projected area.

9. A silver halide photographic light-sensitive material having at least one silver halide emulsion layer on a support, wherein at least one of the silver halide emulsion layers contains a silver halide photographic emulsion including silver halide grains wherein a variation coefficient of distribution of equivalent circle diameters of all the silver halide grains is 40 to 3%, and tabular grains, which satisfy the following requirements (i) to (iv), account for 50% or more of the total projected area of the silver halide grains:

(i) silver bromoiodide or silver bromochloroiodide tabular grains having (111) faces as main planes, (ii) the equivalent circle diameter is 1.0 $\mu$m or more and a thickness is 0.10 $\mu$m or less, (iii) ten or more dislocation lines per grain are present at a fringe portion of the grain, and (iv) when the grain is viewed from a direction perpendicular to the (111) main plane, it has a hexagonal or triangular shape whose edge and/or corner are partly substantially hollowed.

10. The silver halide photographic light-sensitive material according to claim 9, wherein the tabular grains which satisfy the above requirements (i) to (iv), account for 80% or more of the total projected area.

11. The silver halide photographic light-sensitive material according to claim 10, wherein the variation coefficient of the equivalent circle diameters is 25 to 3%.

12. The silver halide photographic light-sensitive material according to claim 11, wherein the variation coefficient of the equivalent circle diameters is 15 to 3%.

13. The silver halide photographic light-sensitive material according to claim 9, wherein the variation coefficient of the equivalent circle diameters is 25 to 3%.

14. The silver halide photographic light-sensitive material according to claim 13, wherein the variation coefficient of the equivalent circle diameters is 15 to 3%.

15. The silver halide photographic light-sensitive material of claim 9, wherein the tabular grains, which satisfy the above requirements (i) to (iv), account for 90 to 100% of the total projected area.

16. The silver halide photographic light-sensitive material of claim 9, wherein the tabular grains, which satisfy the above requirements (i) to (iv), account for 95 to 100% of the total projected area.

* * * * *